US011626684B2

(12) United States Patent
Masuda et al.

(10) Patent No.: US 11,626,684 B2
(45) Date of Patent: Apr. 11, 2023

(54) CONNECTOR INCLUDING A TERMINAL RETAINING MEMBER FOR RETAINING A TERMINAL FITTING HOUSED IN A HOUSING

(71) Applicant: Yazaki Corporation, Tokyo (JP)

(72) Inventors: Satoki Masuda, Shizuoka (JP); Takeo Ida, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 17/527,327

(22) Filed: Nov. 16, 2021

(65) Prior Publication Data

US 2022/0158380 A1 May 19, 2022

(30) Foreign Application Priority Data

Nov. 18, 2020 (JP) ..... JP2020-191358

(51) Int. Cl.

| | |
|---|---|
| ***H01R 13/436*** | (2006.01) |
| ***H01R 13/506*** | (2006.01) |
| ***H01R 13/639*** | (2006.01) |
| ***H01R 13/64*** | (2006.01) |

(52) U.S. Cl.

CPC ..... *H01R 13/4368* (2013.01); *H01R 13/506* (2013.01); *H01R 13/639* (2013.01); *H01R 13/64* (2013.01)

(58) Field of Classification Search

CPC .... H01R 4/64; H01R 13/4368; H01R 13/506; H01R 13/639; H01R 13/64; H01R 13/641; H01R 13/6453; H01R 13/6456; H01R 2201/26

See application file for complete search history.

(56) References Cited

U.S. PATENT DOCUMENTS

| | | | | |
|---|---|---|---|---|
| 2005/0022377 | A1* | 2/2005 | Puskar | H01R 13/6453 29/838 |
| 2010/0159743 | A1* | 6/2010 | Kato | H01R 13/426 439/587 |
| 2012/0270444 | A1* | 10/2012 | Kawamura | H01R 13/5202 439/607.44 |
| 2013/0280950 | A1* | 10/2013 | Becavin | H01R 13/465 439/680 |
| 2022/0094085 | A1* | 3/2022 | Kitaoka | H01R 9/11 |

FOREIGN PATENT DOCUMENTS

| | | | |
|---|---|---|---|
| EP | 2854230 | A1 | 4/2015 |
| JP | 2005-190717 | A | 7/2005 |

* cited by examiner

*Primary Examiner* — Oscar C Jimenez
(74) *Attorney, Agent, or Firm* — Banner & Witcoff, Ltd.

(57) ABSTRACT

A connector includes a terminal fitting, a housing that houses the terminal fitting at a housing complete position, and a terminal retaining member that, at an assembling complete position to the housing, retains the terminal fitting remaining at the housing complete position. The terminal fitting includes a penetration hole. The terminal retaining member includes a retaining protrusion that is, at the assembling complete position, inserted into the penetration hole at the housing complete position, and retains the terminal fitting while the terminal fitting remains at that position. The penetration hole is formed to have a left-right asymmetric shape including a first hole part on the left side and a second hole part having a shape different from a shape of the first hole part and arranged on the right side of the first hole part.

4 Claims, 17 Drawing Sheets

CONNECTOR INCLUDING A TERMINAL RETAINING MEMBER FOR RETAINING A TERMINAL FITTING HOUSED IN A HOUSING

CROSS-REFERENCE TO RELATED APPLICATION(S)

The present application claims priority to and incorporates by reference the entire contents of Japanese Patent Application No. 2020-191358 filed in Japan on Nov. 18, 2020.

BACKGROUND OF THE INVENTION

1. Field of the Invention

The present invention relates to a connector.

2. Description of the Related Art

Conventionally, a connector includes a terminal fitting, and a housing in which this terminal fitting is housed at a housing complete position on an inner side. One of the known connectors includes a terminal retaining member (so-called retainer) that is assembled to the housing and, at an assembling complete position, retains the terminal fitting remaining at the housing complete position. This terminal retaining member includes a protrusion that is inserted into a penetration hole of the terminal fitting so as to retain an inner peripheral wall surface of the penetration hole at the housing complete position. This type of connector is disclosed in Japanese Patent Application Laid-open No. 2005-190717.

Incidentally, in the connector, if whether the terminal fitting is disposed correctly at the housing complete position can be detected in the manufacturing stage, the commercial quality as a product can be secured.

SUMMARY OF THE INVENTION

In view of this, it is an object of the present invention to provide a connector in which whether the terminal fitting is disposed correctly can be detected.

To achieve the above objection, a connector according to one aspect of the invention includes a terminal fitting attached to a terminal of an electric wire; a housing that houses the terminal fitting at a housing complete position in a terminal housing room on an inner side and that is inserted into and engaged with a counterpart engagement part from an end along an inserting direction; and a terminal retaining member that is assembled to the housing from outside along an assembling direction orthogonal to the inserting direction and, at an assembling complete position to the housing, retains the terminal fitting remaining at the housing complete position, wherein the terminal fitting includes a penetration hole, the terminal retaining member includes a retaining protrusion that is, at the assembling complete position, inserted into the penetration hole at the housing complete position, and retains the terminal fitting at the housing complete position while the terminal fitting remains at that position, the penetration hole is formed to have a left-right asymmetric shape including a first hole part that is arranged on a left side in a terminal left-right direction orthogonal to the inserting direction and the assembling direction, and a second hole part that has a shape different from a shape of the first hole part and is arranged on a right side of the first hole part in the terminal left-right direction, and the retaining protrusion is formed to have a left-right asymmetric shape including a first protrusion part that is arranged on the left side in the terminal left-right direction and is, at the assembling complete position, fitted into the first hole part at the housing complete position, and a second protrusion part that has a shape different from a shape of the first protrusion part, is arranged on the right side of the first protrusion part in the terminal left-right direction, and is, at the assembling complete position, fitted into the second hole part at the housing complete position.

According to another aspect of the present invention, in the connector, it is preferable that at least the first protrusion part out of the first protrusion part and the second protrusion part is formed to have a shape that is able to be inserted into the first hole part and is not able to be inserted into the second hole part.

According to still another aspect of the present invention, in the connector, it is preferable that the housing includes the terminal housing room for each of a plurality of the terminal fittings, the terminal fittings include the respective penetration holes with different shapes that are left-right asymmetric, and the terminal retaining member includes the retaining protrusion for each of the penetration holes of the terminal fittings, the retaining protrusion being formed to have a shape that is able to be inserted only into the corresponding penetration hole.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

An embodiment of a connector according to the present invention is hereinafter described in detail with reference to the drawings. Note that the present invention is not limited by this embodiment.

Embodiment

One embodiment of the connector according to the present invention is described with reference to FIG. 1 to FIG. 17.

Figure 1:
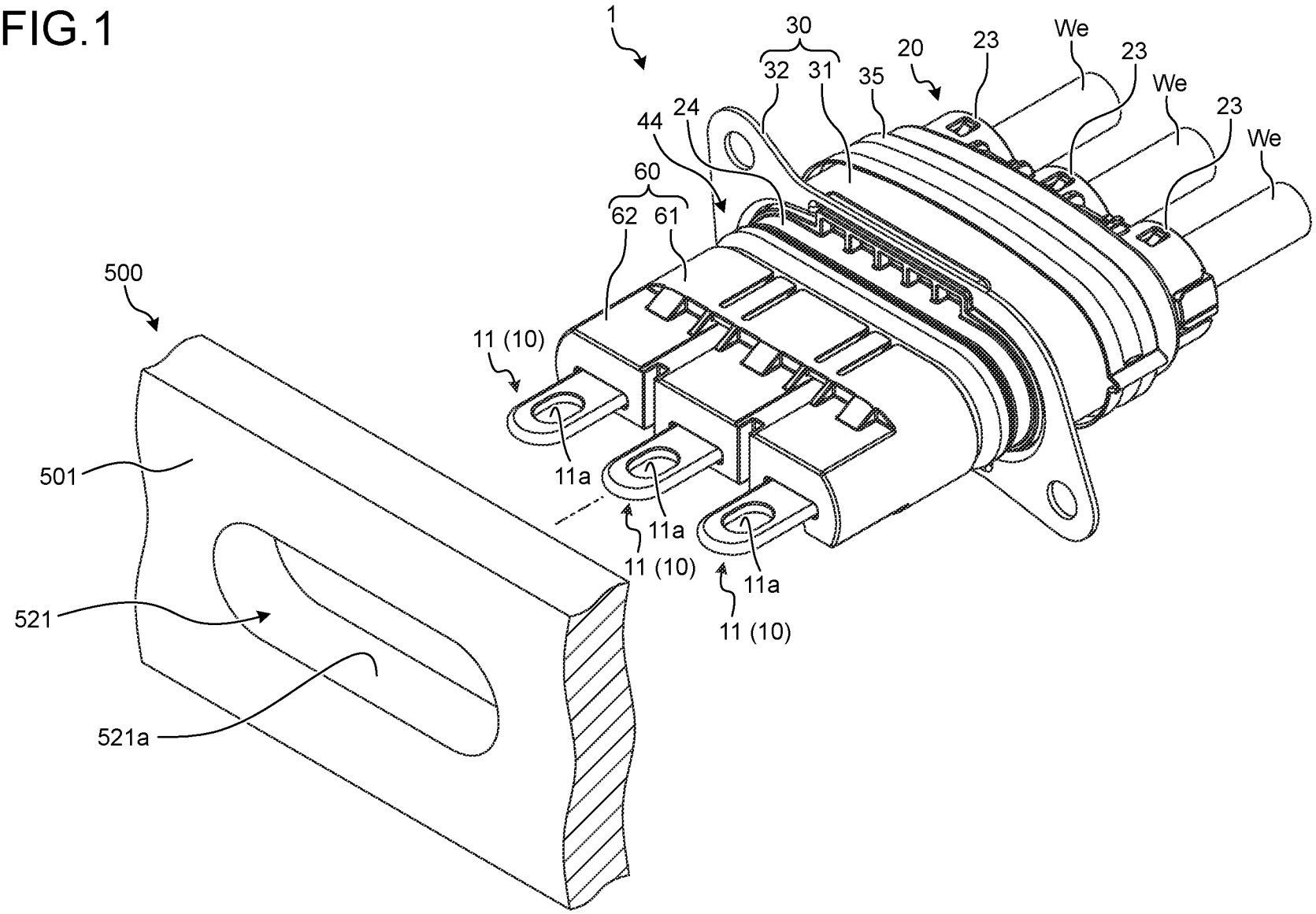
FIG. 1 is a perspective view illustrating a connector according to an embodiment.
Figure 2:
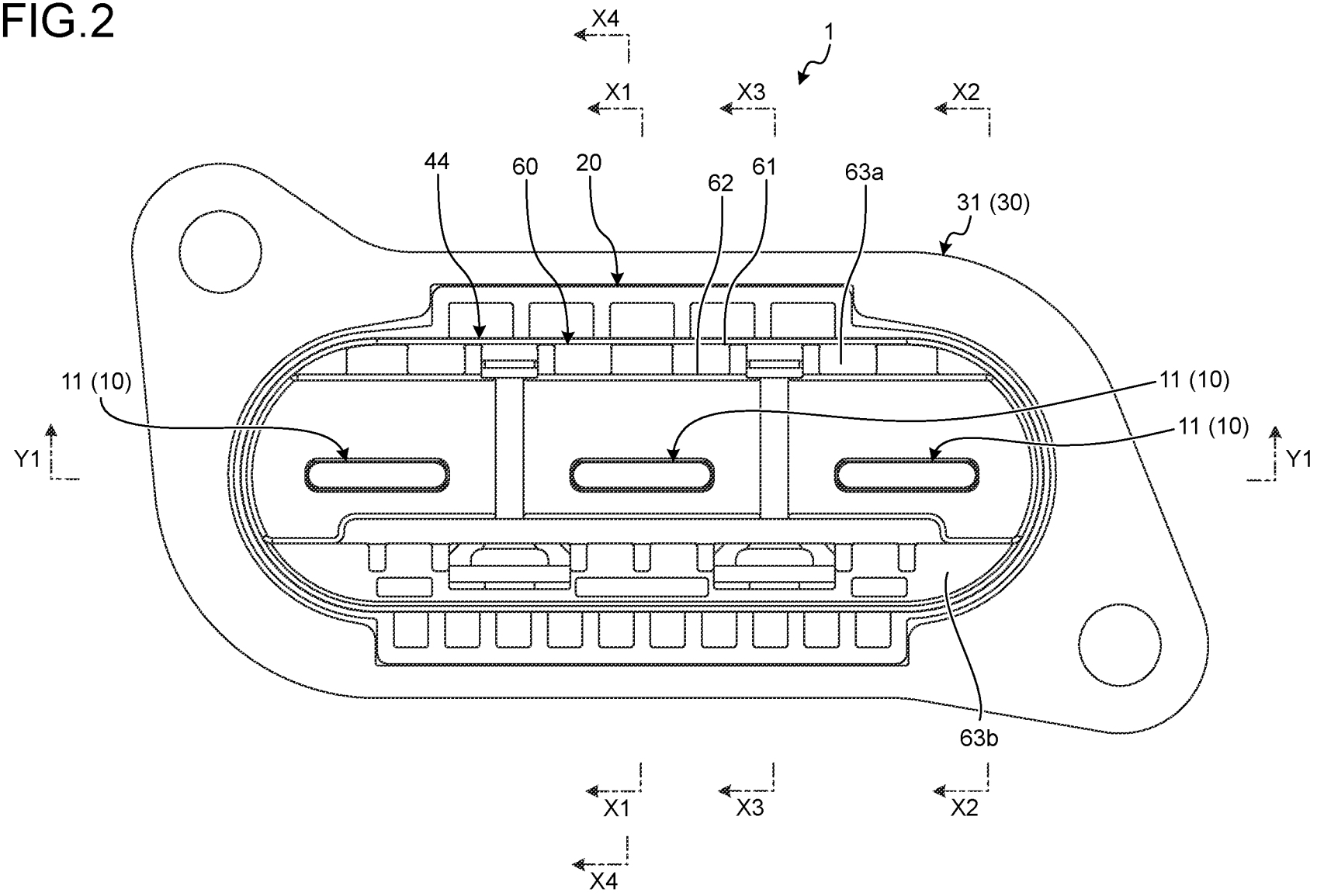
FIG. 2 is a plan view in which the connector according to the embodiment is viewed from an observation window part side.

In FIG. 1 to FIG. 8, reference symbol 1 denotes a connector according to the present embodiment. When this connector 1 is, from its end, inserted into and engaged with a counterpart engagement part 521, the connector 1 is electrically connected to a counterpart terminal fitting (not illustrated) (FIG. 1). For example, the connector 1 illustrated here is configured to be inserted into and engaged with the inside of the counterpart engagement part 521 with a hole shape including an inner peripheral wall surface 521*a*. This connector 1 is inserted into and removed from the counterpart engagement part 521 with a hole shape along a hole axis direction of this counterpart engagement part 521. The counterpart engagement part 521 is formed so that a cross-section thereof orthogonal to the hole axis direction has a circular shape or an elliptical shape, for example. Note that the counterpart engagement part 521 may be formed in a tubular shape and may have an engagement part 21 inserted into and engaged with an internal space of the tubular shape.

For example, by the electric connection of this connector 1 to the counterpart terminal fitting of a counterpart device 500, this counterpart device 500 and a device at the destination of an electric wire We (not illustrated) can be electrically connected (FIG. 1). The counterpart device 500 includes a casing 501 made of metal, and uses a penetration hole formed in a wall body of this casing 501 as the counterpart engagement part 521. This counterpart device 500 includes a terminal base or a counterpart connector (not illustrated) inside the casing 501. The counterpart terminal fitting is provided in the terminal base or the counterpart connector. Therefore, when the connector 1 is inserted into and engaged with the counterpart engagement part 521, the connector 1 is electrically connected to the counterpart terminal fitting of the terminal base or the counterpart connector inside the casing 501.

The inserting direction described hereinafter indicates the inserting direction of the connector 1 with respect to the counterpart engagement part 521 unless otherwise stated. The removing direction described hereinafter indicates the removing direction of the connector 1 with respect to the counterpart engagement part 521 unless otherwise stated. Moreover, the inserting and removing direction described hereinafter indicates the inserting and removing direction of the connector 1 with respect to the counterpart engagement part 521 unless otherwise stated.

This connector 1 includes a terminal fitting 10, a housing 20, and a shield shell 30 (FIG. 1 to FIG. 8).

The terminal fitting 10 is molded of a conductive material such as metal. For example, this terminal fitting 10 is molded into a predetermined shape by press-molding, such as bending processing or cutting processing, of a metal plate that is a base material. This terminal fitting 10 is attached to a terminal of this electric wire We for the electric connection to the electric wire We. In addition, this terminal fitting 10 is electrically connected to the counterpart terminal fitting. Therefore, this terminal fitting 10 includes a terminal connection part 11 that physically and electrically connects to the counterpart terminal fitting, and an electric wire connection part 12 that physically and electrically connects to the terminal of the electric wire We (FIG. 3, FIG. 5, FIG. 8, and FIG. 9).

The terminal connection part 11 illustrated here is formed to have a piece body shape (FIG. 1, FIG. 3, FIG. 5, FIG. 8, and FIG. 9). The terminal connection part 11 illustrated here is formed so that a plane of the piece body extends along the inserting and removing direction. In addition, in the terminal connection part 11 illustrated here, a side part at an end of the piece body with a rectangular shape on the inserting direction side has an arc shape. Moreover, in the terminal connection part 11 illustrated here, a direction orthogonal to the inserting and removing direction and to the direction orthogonal to the plane of the piece body is defined as a left-right direction (hereinafter referred to as "terminal left-right direction"). Here, with respect to the viewpoint in FIG. 2, the left side on the paper surface is the left side of the terminal and the right side on the paper surface is the right side of the terminal.

In addition, the terminal connection part 11 has a penetration hole 11*a* for terminal connection, and the hole axis of this penetration hole 11*a* corresponds to the direction orthogonal to the plane of the piece body (FIG. 1, FIG. 3, FIG. 5, FIG. 8, and FIG. 9). When the terminal connection part 11 is fixed to the counterpart terminal fitting with a screw, for example, through the penetration hole 11*a*, the terminal connection part 11 is physically and electrically connected to this counterpart terminal fitting. Note that the connection mode between the terminal fitting 10 and the counterpart terminal fitting is not necessarily such a screw fixing structure. For example, the terminal fitting 10 and the counterpart terminal fitting have such shapes that can be engaged with and connected to each other, and one of them may be molded into a female terminal shape and the other may be molded into a male terminal shape.

The electric wire connection part 12 is physically and electrically connected to the electric wire We by, for example, compressing or welding to a core wire of the terminal of the electric wire We. The electric wire connection part 12 illustrated here has two barrel pieces thereof connected to the uncovered core wire by caulking, so that the barrel pieces are compressed on the core wire.

The terminal fitting 10 in this example is molded as a straight shape where the terminal connection part 11 and the electric wire connection part 12 are disposed on a straight line. Therefore, the electric wire We is drawn from the electric wire connection part 12 in an extending direction of the terminal fitting 10 along the straight line. Alternatively, this terminal fitting 10 may have the terminal connection part 11 and the electric wire connection part 12 arranged intersecting with each other, for example orthogonal to each other.

This connector 1 includes a plurality of pairs of terminal fittings 10 and electric wires We. The connector 1 illustrated here includes three pairs of terminal fittings 10 and electric wires We.

The housing 20 is molded of an insulating material such as synthetic resin. This housing 20 is an internal room for housing the terminal fitting 10, and includes a terminal housing room 20*a* for each of the terminal fittings 10 (FIG. 3, FIG. 5, FIG. 10, and FIG. 11). This housing 20 houses the terminal fitting 10 at the housing complete position in the terminal housing room 20*a* on the inner side, and also internally houses the terminal of the electric wire We connected to the electric wire connection part 12 of the terminal fitting 10. In this housing 20, the terminal fitting 10 is held in the housed state at the housing complete position and the electric wire We thereof is drawn from the inside to the outside. When this housing 20 is, from its end, inserted into and engaged with the counterpart engagement part along the inserting direction, the terminal fitting 10 at the housing complete position is electrically connected to the counterpart terminal fitting.

This housing 20 internally houses the terminal fitting 10 and includes the engagement part 21 that is inserted into and engaged with the inside of the counterpart engagement part 521 (FIG. 3 to FIG. 8, FIG. 10, and FIG. 11). This engagement part 21 is inserted into and engaged with the inside of the counterpart engagement part 521 along the inserting direction, and is removed from the inside of the counterpart engagement part 521 along the removing direction that is opposite to the inserting direction. This engagement part 21 has a tubular shape whose tube axis direction coincides with the inserting and removing direction (inserting direction, removing direction) with respect to the counterpart engagement part 521. Therefore, the inserting and removing direction may hereinafter be referred to as the tube axis direction.

Inside this engagement part 21, a part of the terminal housing room 20*a* for each terminal fitting 10 is formed. The terminal housing rooms 20*a* are formed in line in a direction orthogonal to the inserting and removing direction. Therefore, inside the engagement part 21, the terminal fittings 10 are housed in line in the orthogonal direction. In addition, the terminal fitting 10 is housed in the terminal housing room 20*a* so that the terminal left-right direction coincides with the direction where the terminal housing rooms 20*a* are arranged (direction where the terminal fittings 10 are arranged). The engagement part 21 illustrated here is formed so that the cross-section orthogonal to the tube axis has an elliptical tubular shape, and along the longitudinal direction of the ellipse, a part of the three terminal housing rooms 20*a* is formed. Inside the engagement part 21, a partition wall (not illustrated) is provided between the adjacent terminal fittings 10, and using this partition wall as a border, a part of the three terminal housing rooms 20*a* is formed. In the terminal housing rooms 20*a* inside the engagement part 21 illustrated here, the electric wire connection part 12 side of the terminal connection part 11 and the terminal connection part 11 side of the electric wire connection part 12 are housed.

The engagement part 21 includes end surfaces 21*b* and 21*c* at end parts that are on the inserting direction side and that are on an outer peripheral wall surface 21*a* side in the orthogonal direction with respect to the inserting direction and the arrangement direction of the three terminal fittings 10 (FIG. 4, FIG. 6, FIG. 7, and FIG. 11). Each of the end surfaces 21*b* and 21*c* is formed as an orthogonal plane with respect to the inserting and removing direction.

Figure 10:
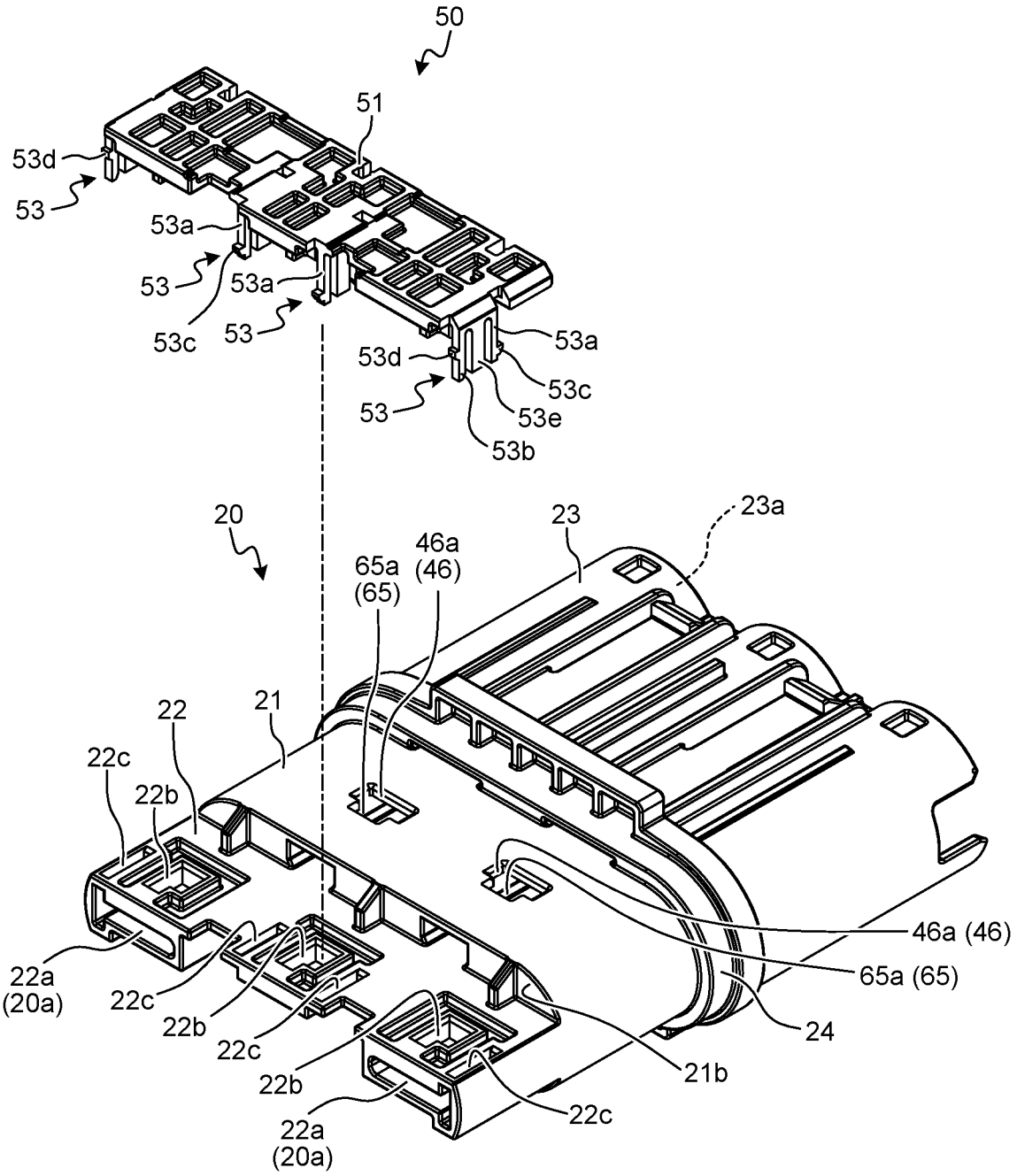
FIG. 10 is an exploded perspective view illustrating a housing and the terminal retaining member.
Figure 11:
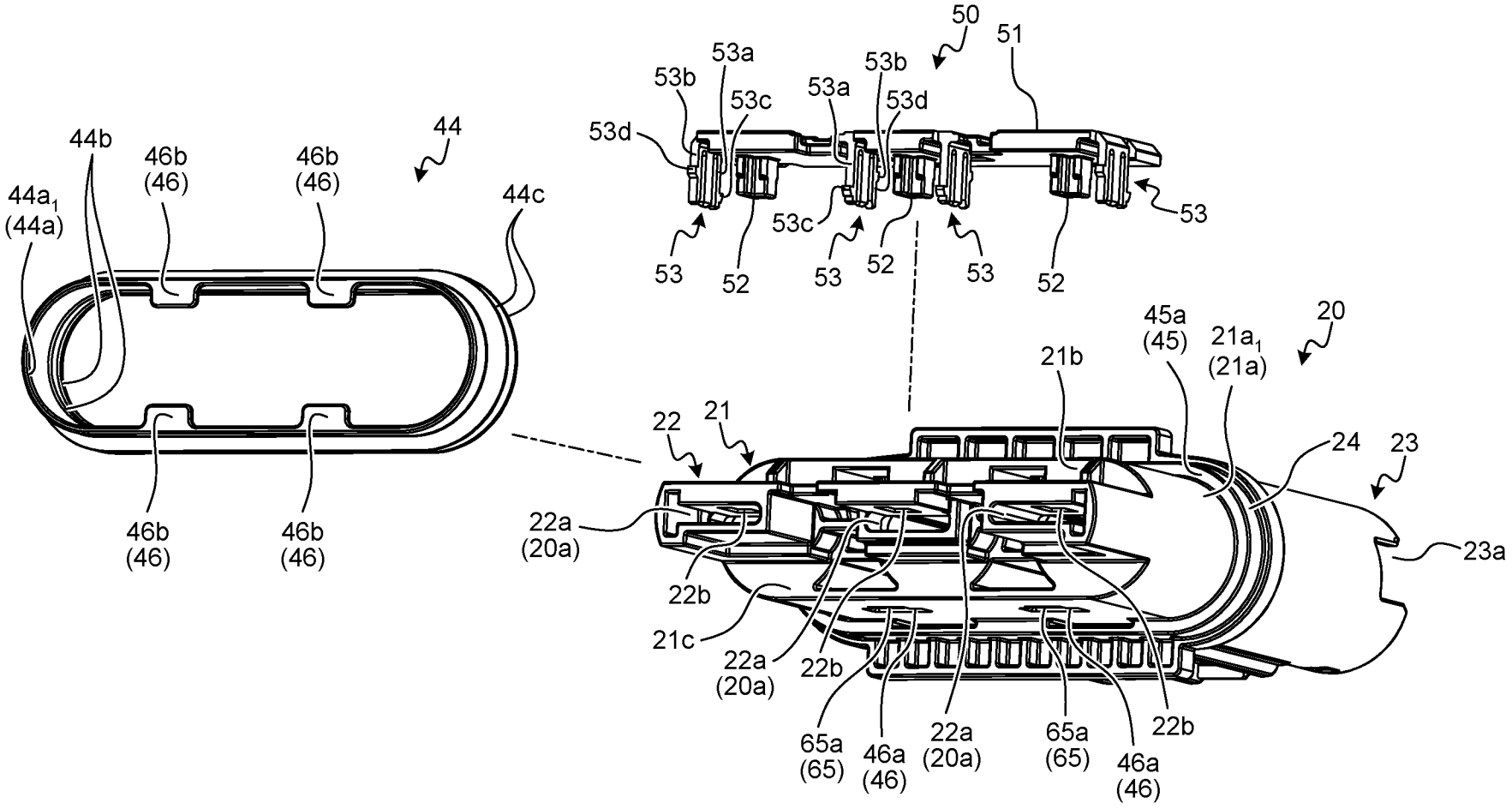
FIG. 11 is an exploded perspective view in which the housing, a water-stopping member, and the terminal retaining member are viewed from different angles.

This housing 20 includes a projection part 22 projecting to the inserting direction over the end surfaces 21*b* and 21*c* of the engagement part 21 between the end surfaces 21*b* and 21*c* (FIG. 3 to FIG. 8, FIG. 10, and FIG. 11). Inside the projection part 22, the terminal fitting 10 is housed. The projection part 22 may be provided for each terminal fitting 10, or may be formed as one protrusion to house all the terminal fittings 10. The projection part 22 illustrated here is to house all the terminal fittings 10, and includes a housing room 22*a* for each terminal fitting 10 (FIG. 10 and FIG. 11). The housing room 22*a* is another part of the terminal housing room 20*a*, which is different from the inside of the engagement part 21, and houses the terminal connection part 11 internally and makes the end part of the terminal connection part 11 on the penetration hole 11*a* side project from the inside to the outside.

In this connector 1, an annular water-stopping member (so-called O-ring) 41 (FIG. 3, FIG. 5, and FIG. 8) is assembled to the terminal connection part 11, and by this water-stopping member 41, an annular space between the terminal connection part 11 and an inner peripheral surface of the housing room 22*a* is closed. In this terminal connection part 11, an annular holding member 42 (FIG. 3, FIG. 5, and FIG. 8) is assembled, and by this holding member 42, the water-stopping member 41 is held.

Figure 3:
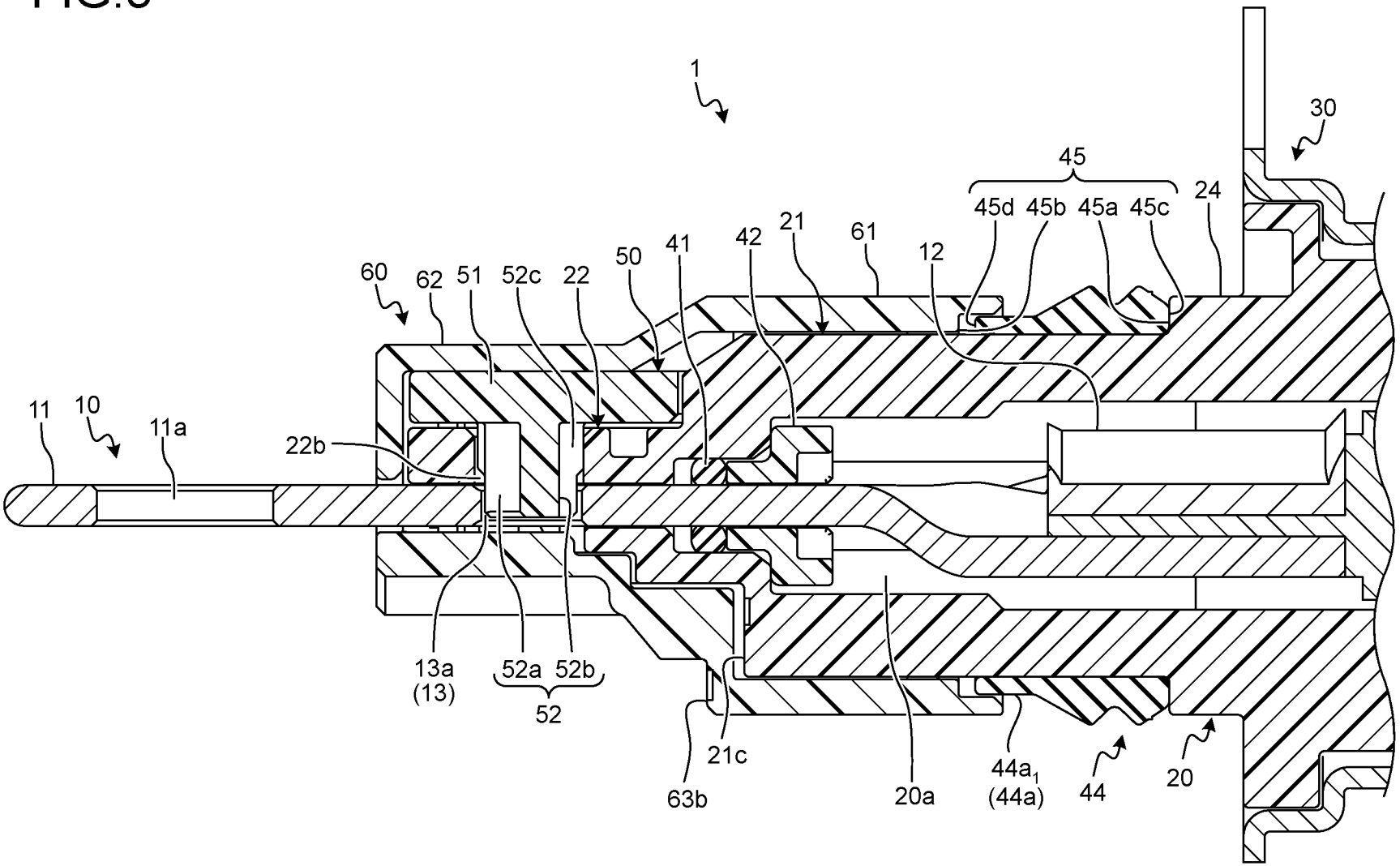
FIG. 3 is a cross-sectional view taken along line X1-X1 in FIG. 2, illustrating that a terminal retaining member is at a final retaining position.
Figure 4:
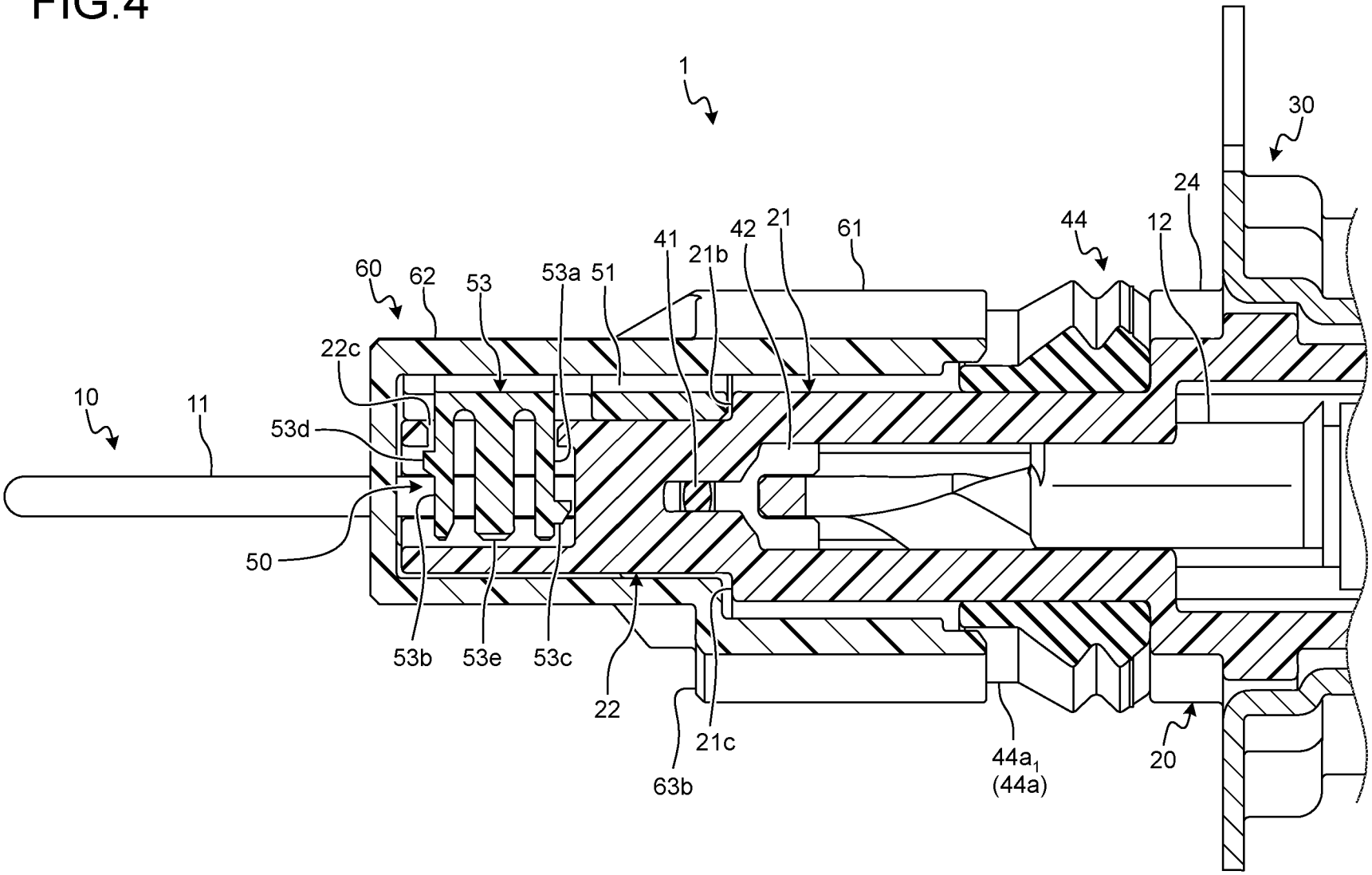
FIG. 4 is a cross-sectional view taken along line X2-X2 in FIG. 2, illustrating that the terminal retaining member is at the final retaining position.
Figure 5:
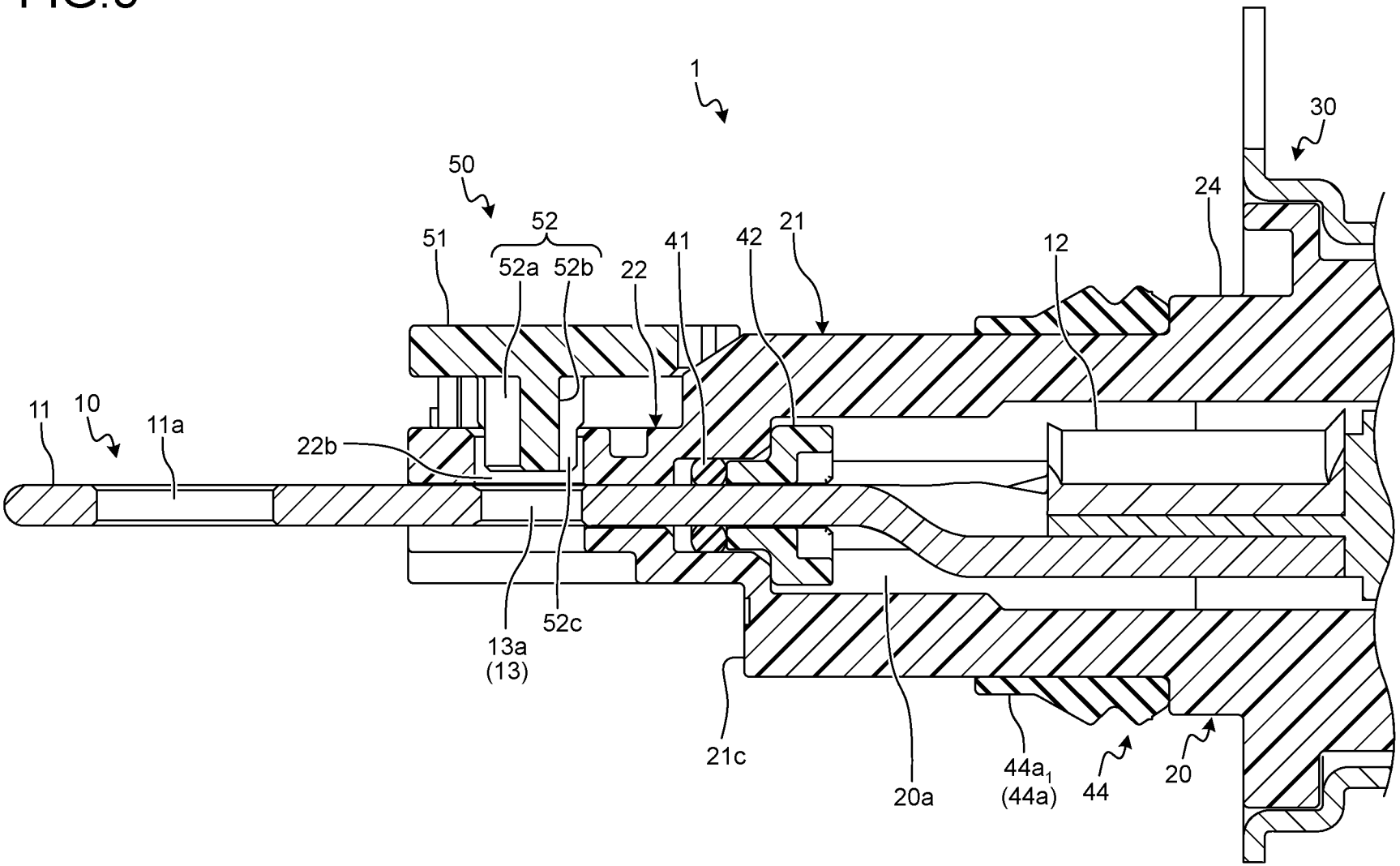
FIG. 5 is a diagram corresponding to a cross-section taken along line X1-X1 in FIG. 2, illustrating that the terminal retaining member is at a temporary retaining position.
Figure 6:
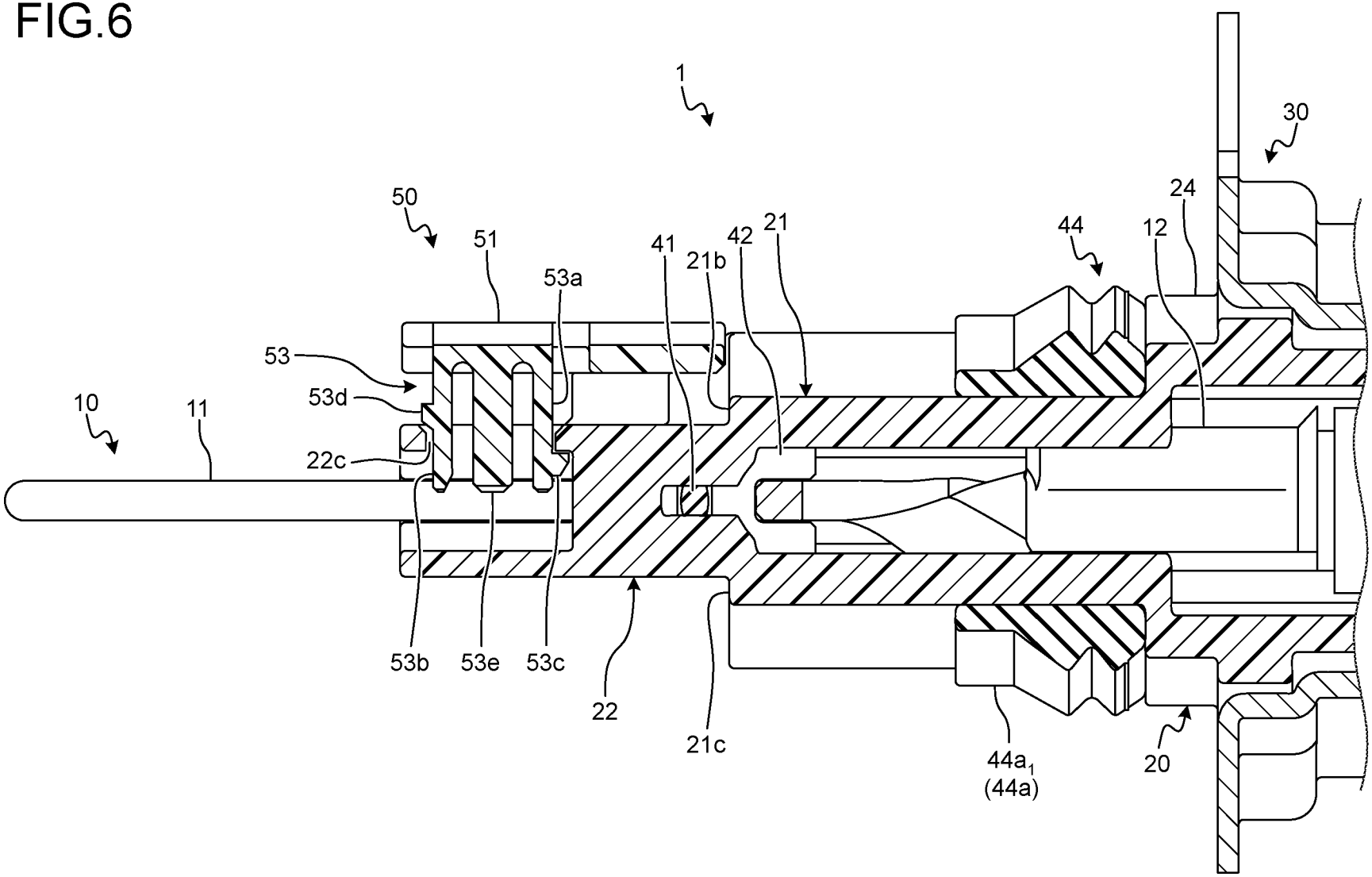
FIG. 6 is a diagram corresponding to a cross-section taken along line X2-X2 in FIG. 2, illustrating that the terminal retaining member is at the temporary retaining position.
Figure 7:
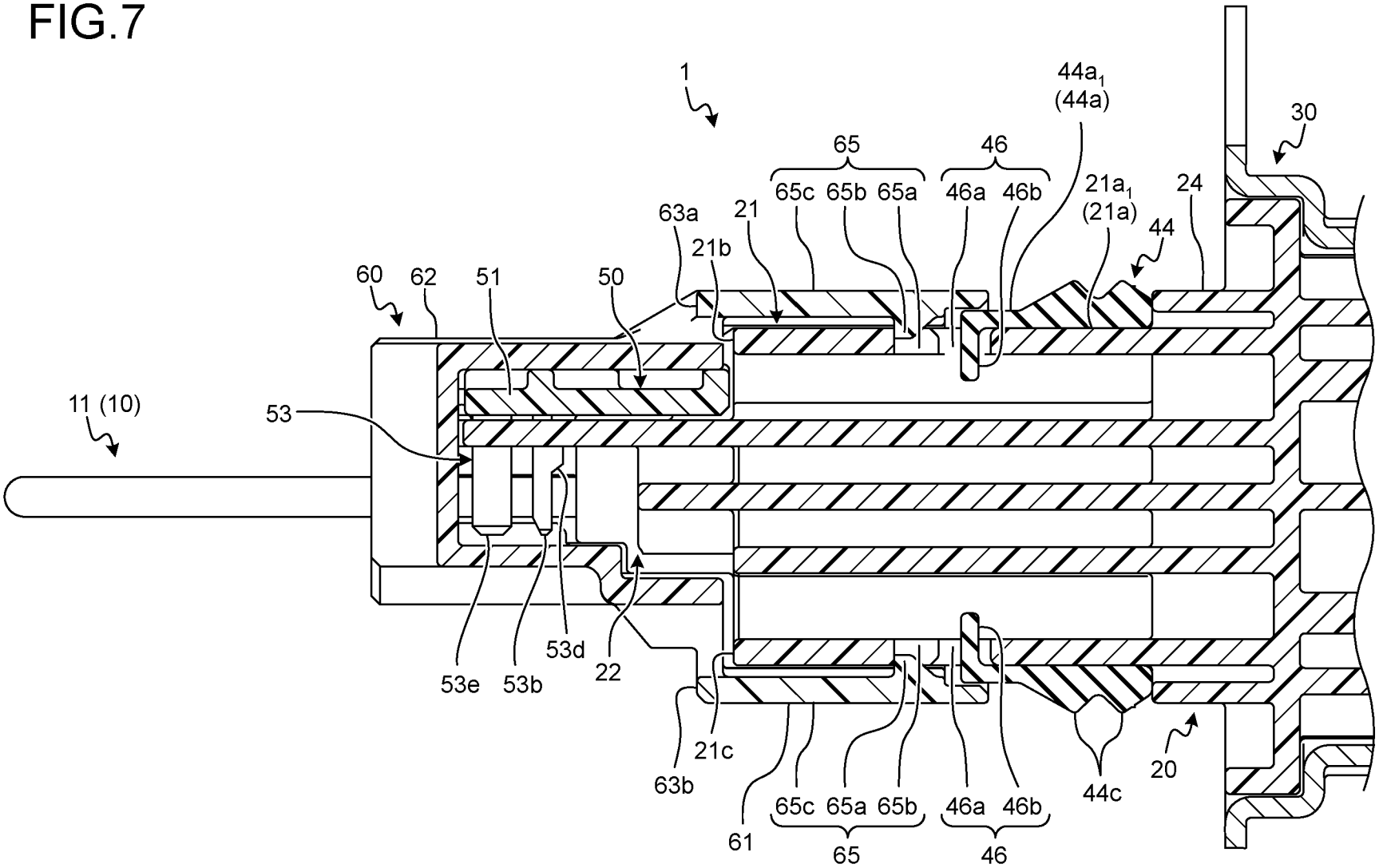
FIG. 7 is a cross-sectional view taken along line X3-X3 in FIG. 2.
Figure 8:
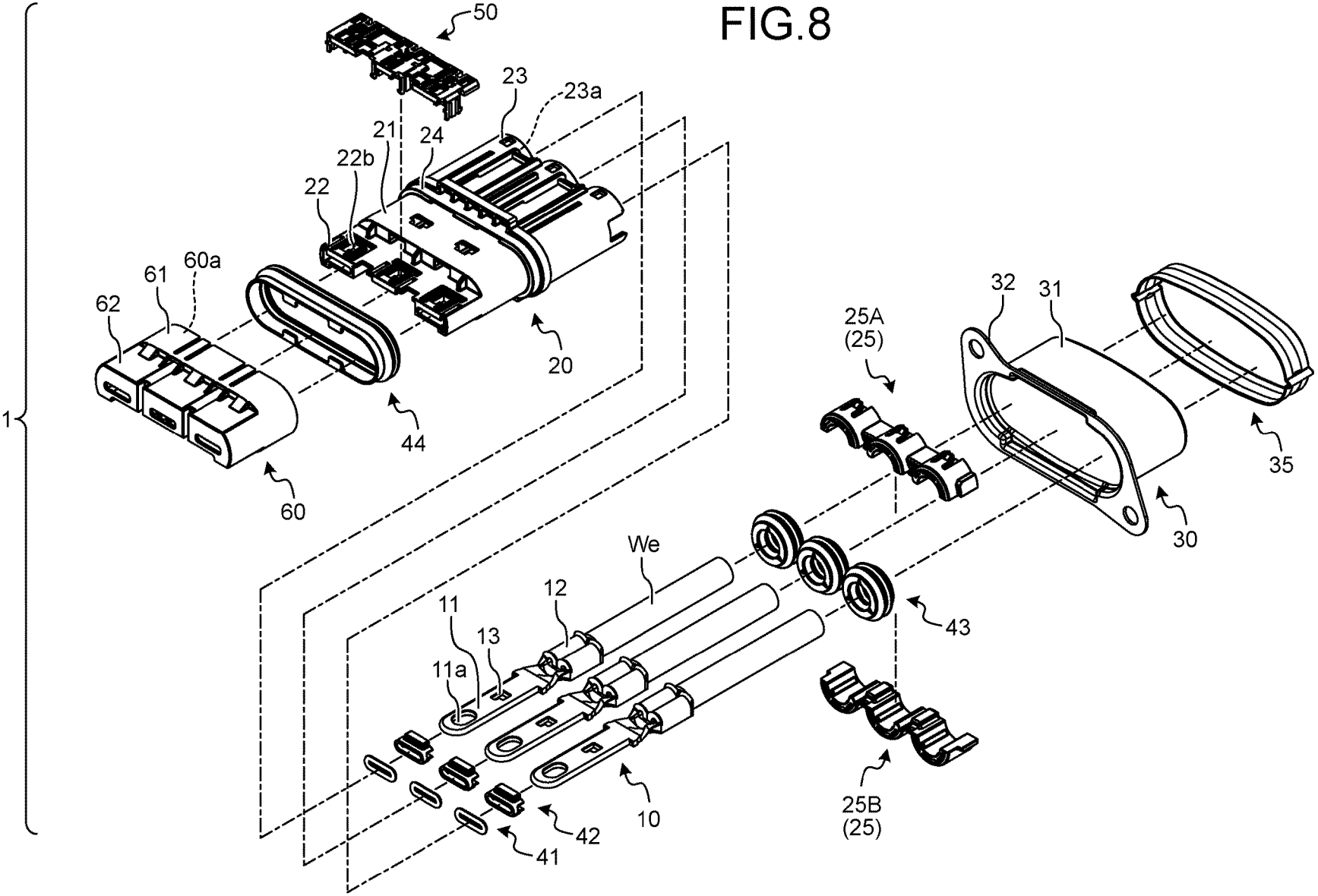
FIG. 8 is an exploded perspective view illustrating the connector according to the embodiment.

The connector 1 includes a terminal retaining member 50 that is assembled to the housing 20 from the outside along the assembling direction orthogonal to the inserting direction, and, at the assembling complete position, retains the terminal fitting 10 remaining at the housing complete position (FIG. 3 to FIG. 8 and FIG. 10 to FIG. 12). This terminal retaining member 50 is assembled to an end side of the housing 20. For example, the terminal retaining member 50 illustrated here is assembled to the projection part 22 at the end of the housing 20, and retains the terminal fitting 10 at the housing complete position remaining in the housed state by this projection part 22. This terminal retaining member 50 includes a retaining protrusion 52 that projects from a main body 51 with a plate shape for each terminal fitting 10 and that is inserted into a penetration hole 13 (FIG. 8 and FIG. 9) serving as a retained part formed in the terminal connection part 11 (FIG. 3, FIG. 5, FIG. 11, and FIG. 12). When the retaining protrusion 52 is inserted into the penetration hole 13 at the housing complete position while the terminal retaining member 50 is at the assembling complete position, the terminal fitting 10 at the housing complete position is retained while the terminal fitting 10 remains at that position (FIG. 3, FIG. 5, and FIG. 8). When the retaining protrusion 52 illustrated here is inserted into the penetration hole 13 at the housing complete position through a penetration hole (hereinafter referred to as "first penetration hole") 22*b* of the projection part 22 while the terminal retaining member 50 is at the assembling complete position, the relative movement of the terminal connection part 11 at the housing complete position with respect to the projection part 22 is retained. The first penetration hole 22*b* is formed for each retaining protrusion 52.

Two of the three first penetration holes 22*b* illustrated here, which are at opposite ends, are holes that communicate to the housing rooms 22*a* at opposite ends so that the housing rooms 22*a* at opposite ends communicate with the outside. When the terminal retaining member 50 is assembled to the projection part 22, the first penetration holes 22*b* at the opposite ends make the retaining protrusions 52 at the opposite ends that are inserted from the outside pass, and the retaining protrusions 52 at the opposite ends are allowed to enter the housing rooms 22*a* at the opposite ends; in this manner, the retaining protrusions 52 at the opposite ends are inserted into the penetration holes 13 of the terminal connection parts 11 in the housing rooms 22*a* at the opposite ends. Moreover, when the terminal retaining member 50 is assembled to the projection part 22, the other first penetration hole 22*b* at the center makes the central retaining protrusion 52 inserted from the outside pass; in this manner, the central retaining protrusion 52 is inserted into the penetration hole 13 of the terminal connection part 11 projecting from the central housing room 22*a*.

The terminal retaining member 50 illustrated here is retained by the housing 20 at a temporary retaining position where the terminal fitting 10 can be inserted into and removed from the housing 20 and at a final retaining position corresponding to the previous assembling complete position where the terminal fitting 10 cannot be inserted into or removed from the housing 20. Specifically, the temporary retaining position is the retaining position for the terminal retaining member 50 with respect to the housing 20 at which the terminal fitting 10 can be inserted to the housing complete position in the housing 20 and the terminal fitting 10 at the housing complete position can be removed from the housing 20, that is, the retaining position for the terminal retaining member 50 with respect to the housing 20 at which the retaining protrusions 52 can be kept in the respective first penetration holes 22*b*. On the other hand, the final retaining position is the retaining position for the terminal retaining member 50 with respect to the housing 20 at which the terminal fitting 10 cannot be inserted to the housing complete position in the housing 20 and the terminal fitting 10 at the housing complete position cannot be removed from the housing 20, that is, the retaining position for the terminal retaining member 50 with respect to the housing 20 at which the retaining protrusions 52 can pass the respective first penetration holes 22*b* and the retaining protrusions 52 can be kept in the state of projecting from the respective first penetration holes 22*b*.

The terminal retaining member 50 includes a retained body 53 that can be retained by the housing 20 at the temporary retaining position and the final retaining position (FIG. 4, FIG. 6, and FIG. 10 to FIG. 12). This retained body 53 includes a first flexible part 53*a* with flexibility and a cantilever shape projecting in the same direction as the retaining protrusion 52, a second flexible part 53*b* with flexibility and a cantilever shape projecting by the same length in the same direction as the first flexible part 53*a* and disposed to face, with a gap from, the first flexible part 53*a*, a first protrusion part 53*c* projecting to the side opposite to the second flexible part 53*b* on a free end side of the first flexible part 53*a*, and a second protrusion part 53*d* projecting to the side opposite to the first flexible part 53*a* on the side closer to a fixed end than to a free end of the second flexible part 53*b*. Note that the terminal retaining member 50 illustrated here includes a piece part 53*e* formed to have a rectangular piece body shape between the first flexible part 53*a* and the second flexible part 53*b*.

The housing 20 includes a penetration hole 22*c* penetrating this retained body 53 (hereinafter referred to as "second penetration hole") (FIG. 4, FIG. 6, and FIG. 10). Here, a flat plate part of the projection part 22 includes a second penetration hole 22*c* whose hole axis direction coincides with the direction orthogonal to the plane. The terminal retaining member 50 causes the projection part 22 to perform the retaining at the temporary retaining position in a manner that the first protrusion part 53*c* is retained on one plane of the flat plate part of the projection part 22 at a peripheral edge part of the second penetration hole 22*c* (plane on the projecting direction side of the first flexible part 53*a* or the second flexible part 53*b*) and the second protrusion part 53*d* is retained on the other plane of the flat plate part of the projection part 22 at the peripheral edge part of the second penetration hole 22*c* (plane on the opposite side of the projecting direction of the first flexible part 53*a* or the second flexible part 53*b*). Moreover, this terminal retaining member 50 causes the projection part 22 to perform the retaining at the final retaining position in a manner that the second protrusion part 53*d* is retained on one plane of the flat plate part of the projection part 22 at the peripheral edge part of the second penetration hole 22*c*. Thus, the first protrusion part 53*c* and the second protrusion part 53*d* are arranged displaced from each other with the distance therebetween equal to the length of the second penetration hole 22*c* in the hole axis direction (in other words, the plate thickness of the flat plate part of the projection part 22) in the projecting direction of the first flexible part 53*a* or the second flexible part 53*b*.

For example, the first flexible part 53*a* and the second flexible part 53*b* illustrated here are formed to have a rectangular parallelepiped shaft shape whose longitudinal direction coincides with their projecting direction, and are disposed to have their planes facing each other. The first protrusion part 53*c* illustrated here projects in a claw shape from the plane (protrusion side plane) on the opposite side of the second flexible part 53*b* on the free end side of the first flexible part 53*a*. The second protrusion part 53*d* illustrated here projects in a claw shape from the plane (protrusion side plane) on the opposite side of the first flexible part 53*a* at the substantial center of the second flexible part 53*b*. The second penetration hole 22*c* illustrated here is formed to have a rectangular parallelepiped shape. The second penetration hole 22*c* is formed so that the gap between the opposing two wall surfaces becomes equal to the gap between the planes, on the protrusion side, of the first flexible part 53*a* and the second flexible part 53*b* that are not in the elastically deformed state. Therefore, on each of the free end sides of the first flexible part 53*a* and the second flexible part 53*b* in the first protrusion part 53*c* and the second protrusion part 53*d*, an inclined surface that elastically deforms the first flexible part 53*a* and the second flexible part 53*b* into the second penetration hole 22*c* by the force from the peripheral edge part of the second penetration hole 22*c* in the projection part 22 is provided.

The terminal retaining member 50 illustrated here includes the retained bodies 53 at four positions with each retaining protrusion 52 placed therebetween. In the projection part 22 illustrated here, the second penetration hole 22*c* is formed for each retained body 53.

In the terminal retaining member 50, all the retained bodies 53 are inserted into the second penetration holes 22*c* from their free end sides of the first flexible part 53*a* and the second flexible part 53*b*, and all the retaining protrusions 52 are inserted into the first penetration holes 22*b* from their end parts on the projecting direction side. Thus, in this terminal retaining member 50, the first flexible part 53*a* is elastically deformed through the first protrusion part 53*c* pressed by the wall surface of the second penetration hole 22*c* and when the first protrusion part 53*c* passes the second penetration hole 22*c*, the elastic deformation of the first flexible part 53*a* is canceled and the first protrusion part 53*c* is retained on one plane of the flat plate part of the projection part 22 at the peripheral edge part of the second penetration hole 22*c* and the second protrusion part 53*d* is retained on the other plane of the flat plate part of the projection part 22 at the peripheral edge part of the second penetration hole 22*c*. Therefore, this terminal retaining member 50 is retained at the temporary retaining position by the projection part 22 while the retaining protrusions 52 are kept in the respective first penetration holes 22*b*.

Note that in two of the four retained bodies 53 illustrated here that are on the outside, the first flexible part 53*a* with the first protrusion part 53*c* is disposed on the removing direction side and the second flexible part 53*b* with the second protrusion part 53*d* is disposed on the inserting direction side (FIG. 11). On the other hand, in two of the four retained bodies 53 that are on the inside, the first flexible part 53*a* with the first protrusion part 53*c* is disposed on the inserting direction side and the second flexible part 53*b* with the second protrusion part 53*d* is disposed on the removing direction side (FIG. 11).

In this connector 1, the terminal fitting 10 is inserted to the housing complete position in the housing 20 while the terminal retaining member 50 is at the temporary retaining position.

Subsequently, in this terminal retaining member 50, by being pushed toward the projection part 22 from the temporary retaining position, the second flexible part 53*b* is elastically deformed through the second protrusion part 53*d* pressed by the wall surface of the second penetration hole 22*c* and when the second protrusion part 53*d* passes the second penetration hole 22*c*, the elastic deformation of the second flexible part 53*b* is canceled and the second protrusion part 53*d* is retained on one plane of the flat plate part of the projection part 22 at the peripheral edge part of the second penetration hole 22*c*. Therefore, the terminal retaining member 50 is retained at the final retaining position by the projection part 22 while the retaining protrusions 52 project from the respective first penetration holes 22*b* and are kept inserted into the penetration holes 13 of the respective terminal connection parts 11. Thus, in this connector 1, when the terminal retaining member 50 is at the final retaining position, the terminal fitting 10 can be continuously held at the housing complete position in the housing 20.

Here, in this connector 1, the terminal fitting 10 can be removed from the housing 20 by moving the terminal retaining member 50 at the final retaining position to the temporary retaining position.

In this connector 1, by using this terminal retaining member 50, whether the terminal fitting 10 is disposed correctly at the housing complete position can be detected.

Figure 9:
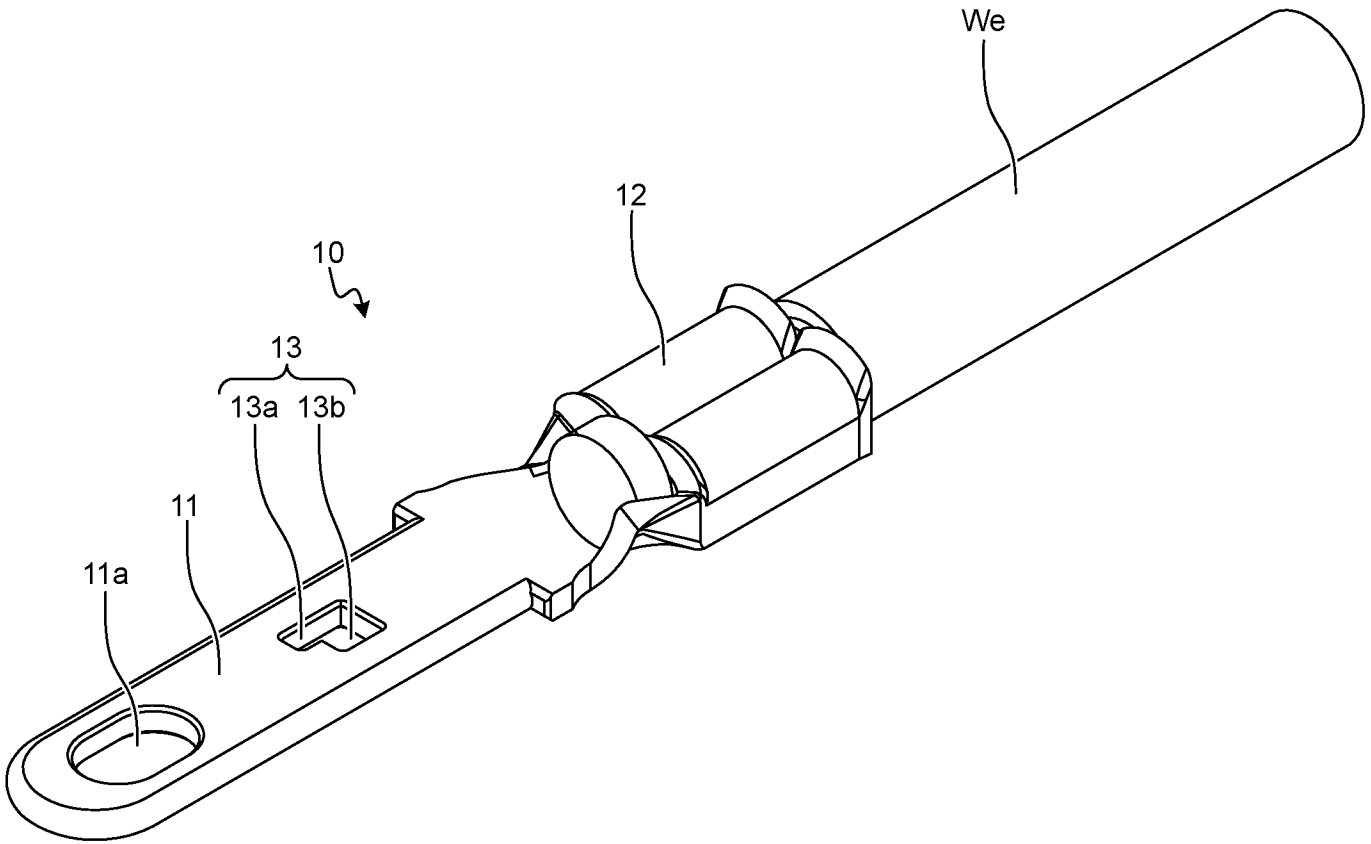
FIG. 9 is a perspective view illustrating a terminal fitting.
Figure 13:
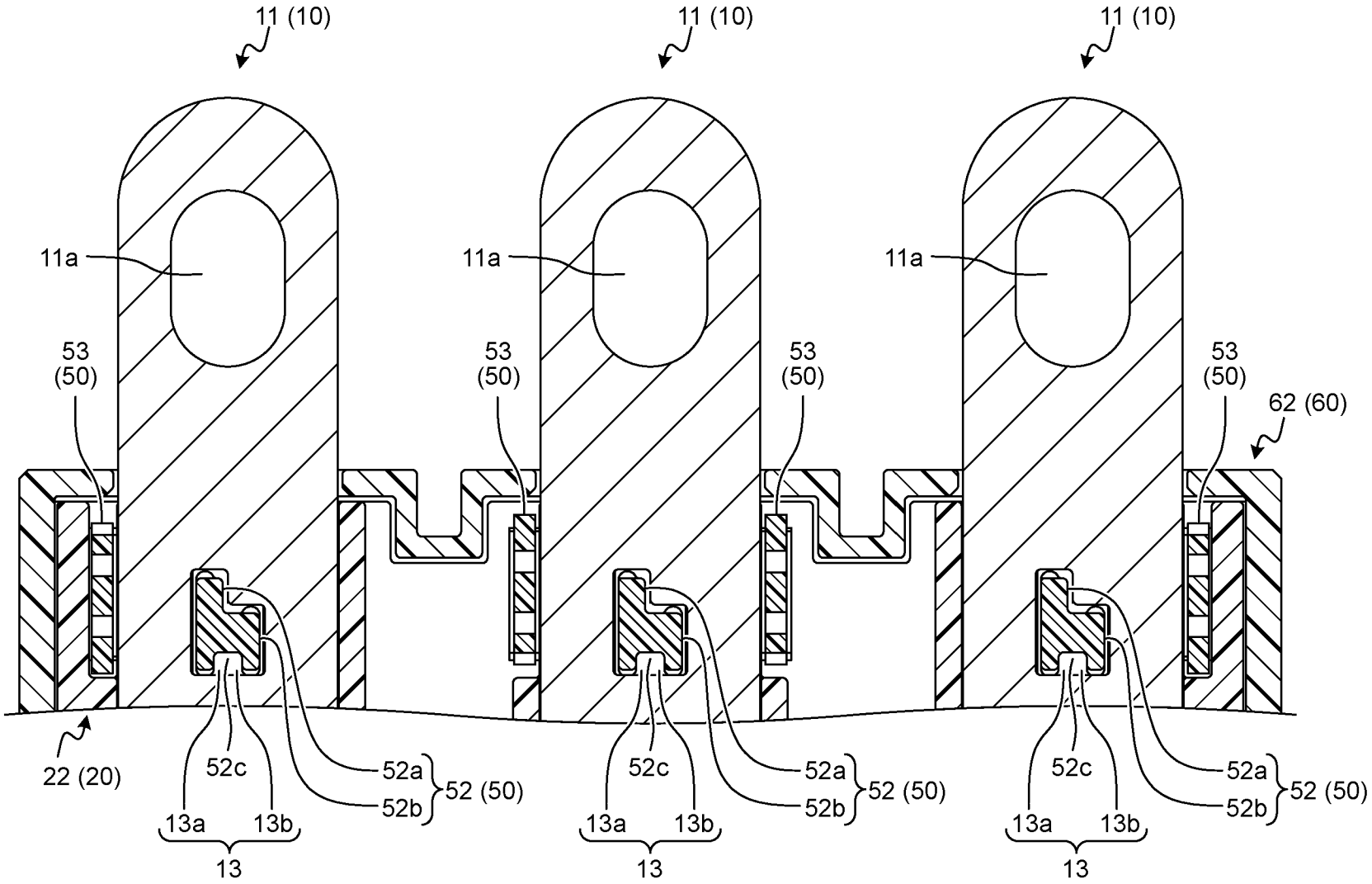
FIG. 13 is a diagram illustrating the retaining protrusions and the penetration holes and their periphery extracted from a cross-section taken along Y1-Y1 in FIG. 2.

First, in this connector 1, the penetration hole 13 as the retained part of the terminal fitting 10 is formed to have the following shape. This penetration hole 13 is formed to have a left-right asymmetric shape including a first hole part 13*a* on the left side in the terminal left-right direction that is orthogonal to the inserting direction and the assembling direction, and a second hole part 13*b*, whose shape is different from the shape of the first hole part 13*a*, on the right side of the first hole part 13*a* in the terminal left-right direction (FIG. 9 and FIG. 13). In the connector 1 illustrated here, all the terminal fittings 10 are the same products and the penetration holes 13 of all the terminal fittings 10 are formed to have the same left-right asymmetric shape.

Subsequently, in this connector 1, the retaining protrusion 52 of the terminal retaining member 50 is formed to have the following shape. This retaining protrusion 52 is formed to have a left-right asymmetric shape including a first protrusion part 52*a* that is arranged on the left side in the terminal left-right direction when being inserted into the penetration hole 13, and is, at the assembling complete position, fitted into the first hole part 13*a* at the housing complete position, and a second protrusion part 52*b*, whose shape is different from the shape of the first protrusion part 52*a*, that is arranged on the right side of the first protrusion part 52*a* in the terminal left-right direction and is, at the assembling complete position, fitted into the second hole part 13*b* at the housing complete position (FIG. 3, FIG. 5, FIG. 12, and FIG. 13). In the connector 1 illustrated here, the penetration holes 13 of all the terminal fittings 10 are formed to have the same left-right asymmetric shape; therefore, all the retaining protrusions 52 of the terminal retaining member 50 are formed to have the same left-right asymmetric shape.

Figure 14:
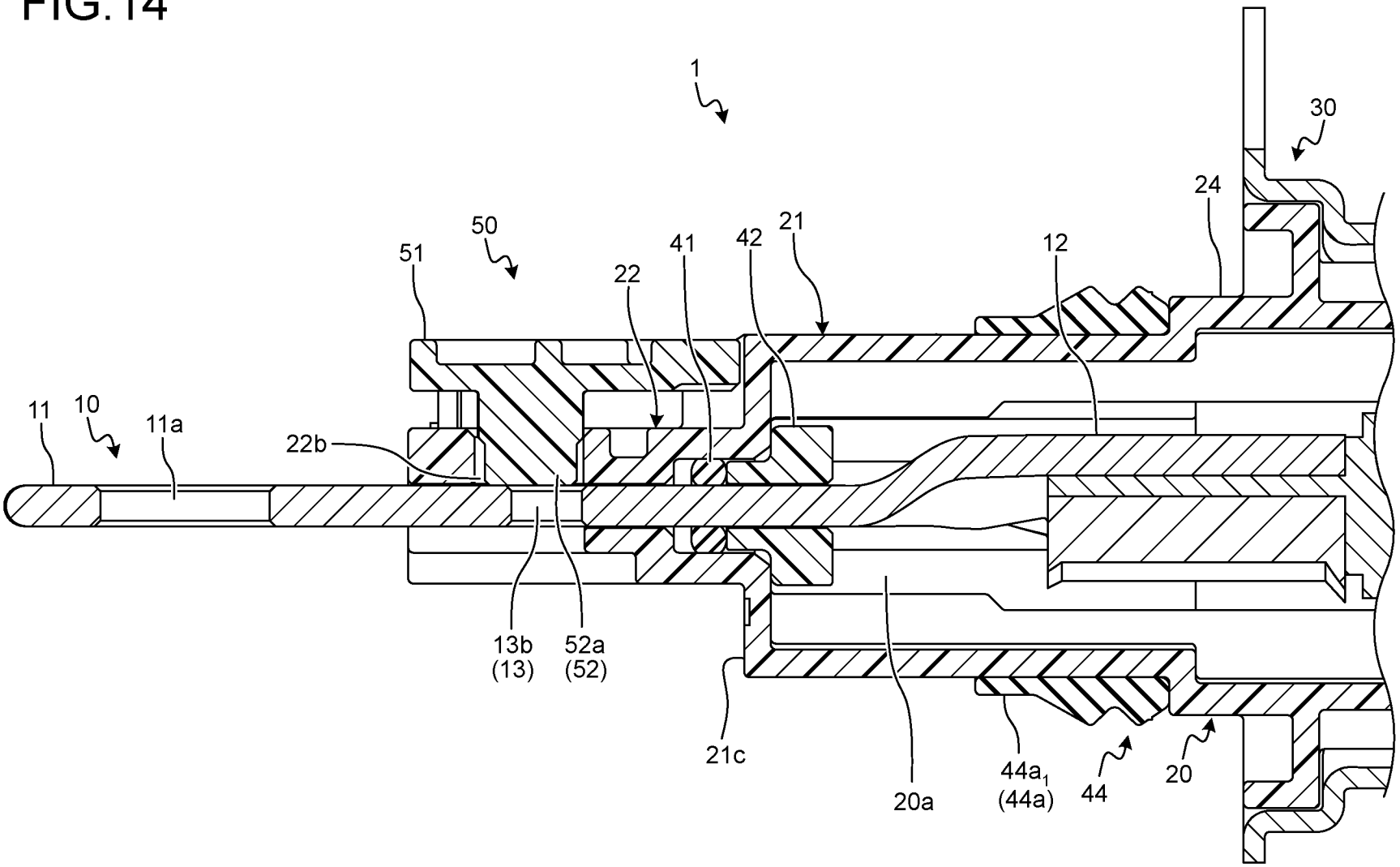
FIG. 14 is a cross-sectional view illustrating a state in which the terminal fitting is disposed in the reversed state at a position of a cross-section taken along X4-X4 in FIG. 2.

In this connector 1, in the case where the terminal fitting 10 is disposed correctly at the housing complete position, when the terminal retaining member 50 is assembled to the projection part 22 of the housing 20 (here, when the terminal retaining member 50 is moved from the temporary retaining position to the final retaining position), the retaining protrusion 52 of the terminal retaining member 50 is fitted to the penetration hole 13 of the terminal fitting 10 and thus, the assembling of the terminal retaining member 50 to the projection part 22 of the housing 20 is completed (FIG. 3 and FIG. 13). On the other hand, in this connector 1, in the case where the two planes of the terminal connection part 11 are reversed and the terminal fitting 10 is not disposed correctly at the housing complete position, the positions of the first hole part 13*a* and the second hole part 13*b* are opposite on the left and on the right in the penetration hole 13. Therefore, when the terminal retaining member 50 is assembled to the projection part 22 of the housing 20, the first protrusion part 52*a* of the retaining protrusion 52 in the terminal retaining member 50 is not fitted into the penetration hole 13 and collides with one plane of the terminal connection part 11 of the terminal fitting 10; accordingly, the assembling of the terminal retaining member 50 to the projection part 22 of the housing 20 is not completed (FIG. 14 and FIG. 15).

Note that in the case where the terminal fitting 10 is not disposed correctly at the housing complete position in the connector 1, for example if the amount of pushing the terminal fitting 10 into the terminal housing room 20*a* is insufficient or the amount of pushing the terminal fitting 10 into the terminal housing room 20*a* is excessive, when the terminal retaining member 50 is assembled to the projection part 22 of the housing 20, the retaining protrusion 52 of the terminal retaining member 50 collides with one plane of the terminal connection part 11 of the terminal fitting 10 at the place that is not related to the penetration hole 13; therefore, the assembling of the terminal retaining member 50 to the projection part 22 of the housing 20 is not completed.

That is to say, in this connector 1, in the case where the terminal fitting 10 is disposed correctly at the housing complete position in the housing 20, the retaining protrusion 52 of the terminal retaining member 50 can be fitted into the penetration hole 13 of the terminal fitting 10; therefore, this terminal retaining member 50 can be assembled to the assembling complete position in the housing 20. Thus, in such a case, this connector 1 can notify the user, for example, that the terminal fitting 10 is disposed correctly at the housing complete position in the housing 20. On the other hand, in the case where the terminal fitting 10 is not disposed correctly at the housing complete position in the connector 1, the retaining protrusion 52 of the terminal retaining member 50 cannot be fitted into the penetration hole 13 of the terminal fitting 10; therefore, the terminal retaining member 50 cannot be assembled to the assembling complete position in the housing 20. Accordingly, in such a case, this connector 1 can notify the user, for example, that the terminal fitting 10 is not disposed correctly at the housing complete position in the housing 20.

Figure 15:
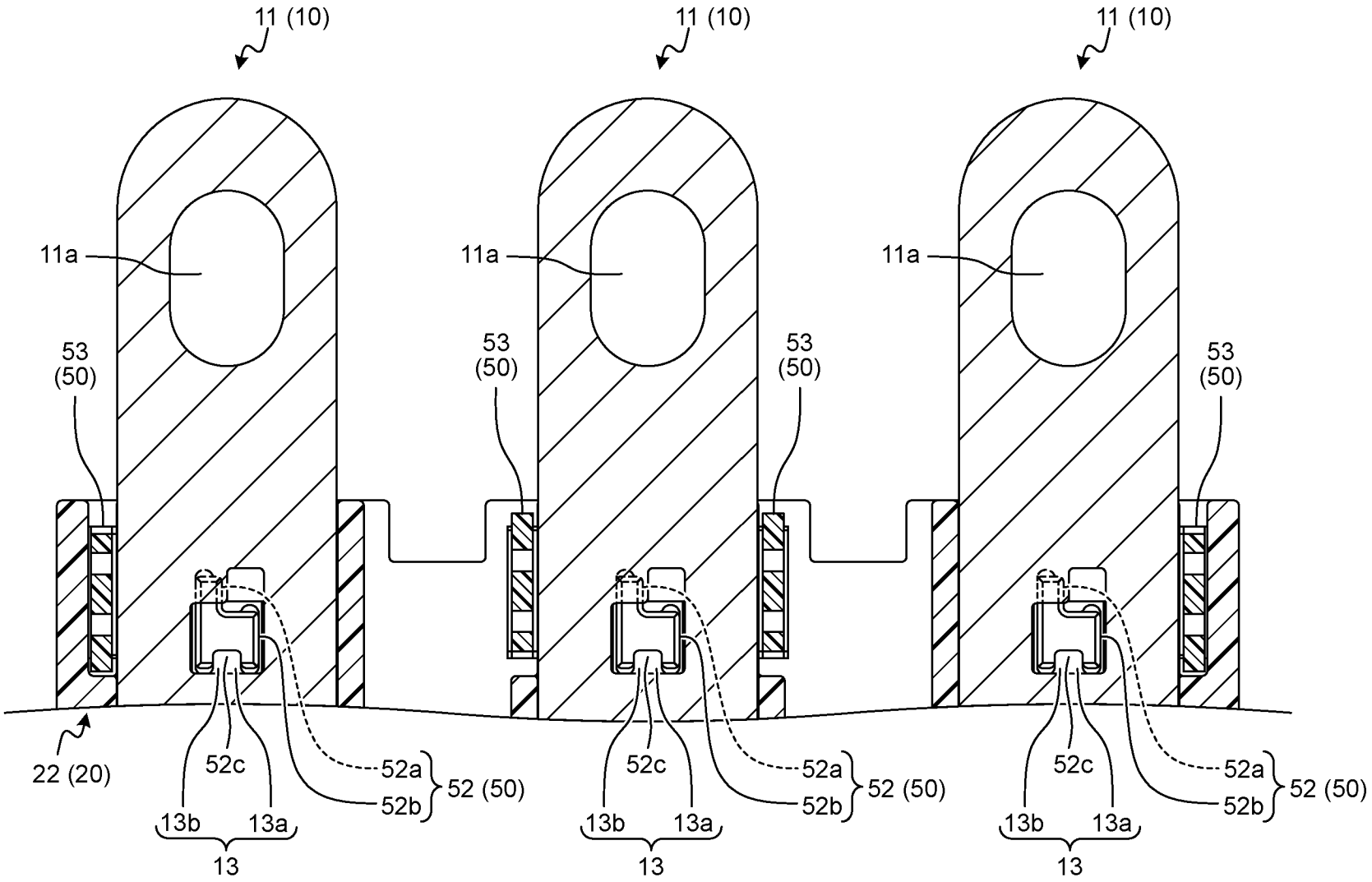
FIG. 15 is a diagram illustrating the retaining protrusions and the penetration holes and their periphery extracted from the cross-section taken along Y1-Y1 in FIG. 2 in a state where the terminal fittings are disposed in the reversed state.

Specifically, at least the first protrusion part 52*a* out of the first protrusion part 52*a* and the second protrusion part 52*b* is formed to have the shape that can be inserted into the first hole part 13*a* and cannot be inserted into the second hole part 13*b* (FIG. 13 and FIG. 15).

The penetration hole 13 illustrated here is formed as the penetration hole with the rectangular hole shape in which the first hole part 13*a* and the second hole part 13*b* include the side parts extending along the inserting and removing direction and the terminal left-right direction and the rectangular area of the second hole part 13*b* is smaller than the rectangular area of the first hole part 13*a* (FIG. 9 and FIG. 13). In addition, in the penetration hole 13 illustrated here, the side parts of the first hole part 13*a* and the second hole part 13*b* on the removing direction side are arranged at the same position in the inserting and removing direction, and the side part of the second hole part 13*b* on the inserting direction side is arranged displaced to the removing direction side relative to the side part of the first hole part 13*a* on the inserting direction side.

Figure 12:
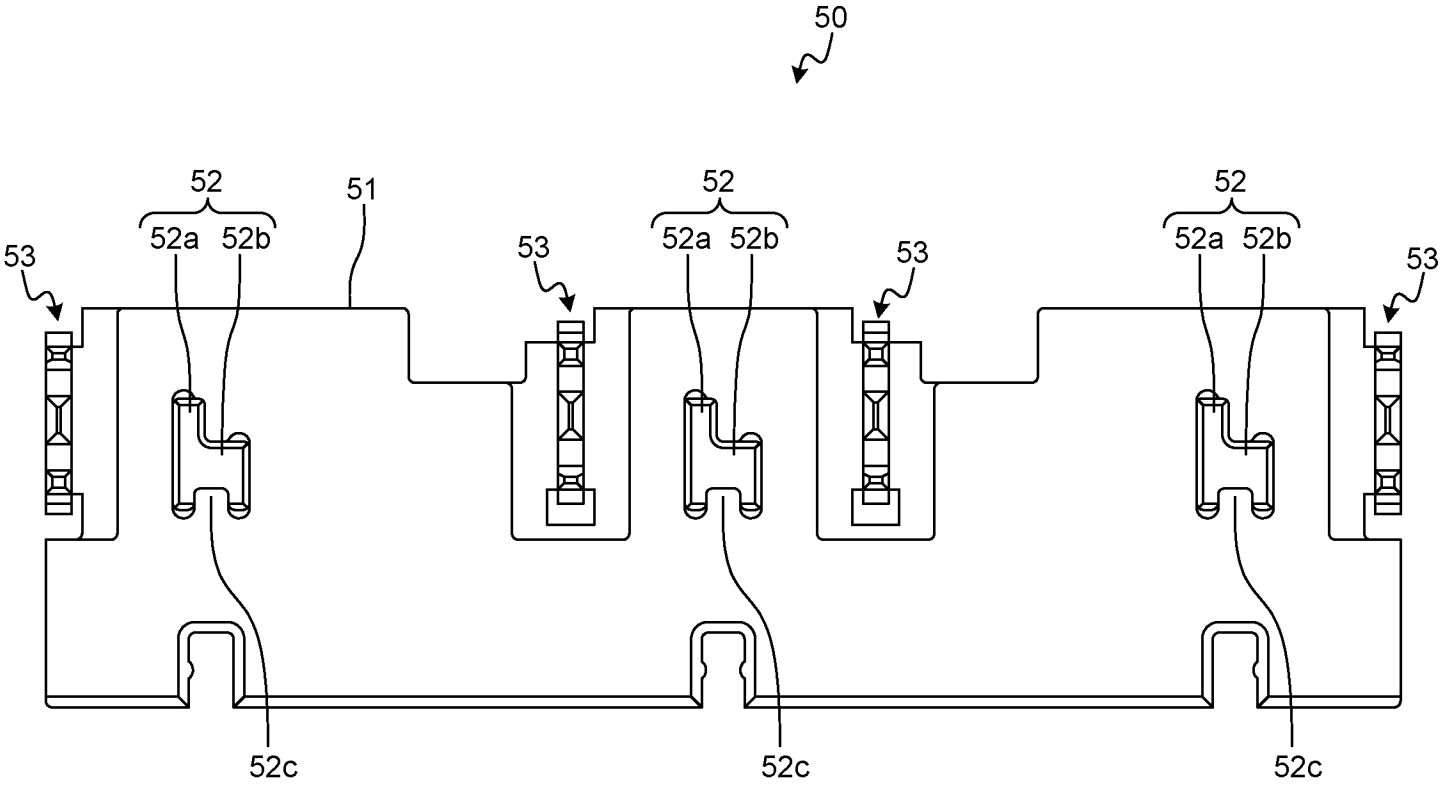
FIG. 12 is a plan view in which the terminal retaining member is viewed from a retaining protrusion side.

The retaining protrusion 52 is formed as a protrusion body whose cross-sectional shape orthogonal to the assembling direction (inserting direction into the penetration hole 13) of the terminal retaining member 50 to the projection part 22 of the housing 20 is similar to the hole shape of the penetration hole 13 (FIG. 12 and FIG. 13). The homothetic ratio between the orthogonal cross-sectional shape of the retaining protrusion 52 and the hole shape of the penetration hole 13 is less than 1, and with these shapes, the retaining protrusion 52 can be fitted into the penetration hole 13.

The retaining protrusion 52 illustrated here is formed as the protrusion body with the rectangular cross-sectional shape in which the first protrusion part 52*a* and the second protrusion part 52*b* in the orthogonal cross-sectional shape include the side parts extending along the inserting and removing direction and the terminal left-right direction. This protrusion body has the shape that can have the rectangular cross-section of the first protrusion part 52*a* fitted into the first hole part 13*a*, and the rectangular cross-section of the second protrusion part 52*b* fitted into the second hole part 13*b*. Therefore, the retaining protrusion 52 illustrated here is formed as the protrusion body in which, in the orthogonal cross-sectional shape thereof, the area of the rectangular cross-section of the second protrusion part 52*b* is smaller than the area of the rectangular cross-section of the first protrusion part 52*a*. In the retaining protrusion 52 illustrated here, in the orthogonal cross-sectional shape thereof, the side parts of the rectangular cross-section of the first protrusion part 52*a* and the rectangular cross-section of the second protrusion part 52*b* on the removing direction side are arranged at the same position in the inserting and removing direction, and the side part of the rectangular cross-section of the second protrusion part 52*b* on the inserting direction side is arranged displaced to the removing direction side relative to the side part of the rectangular cross-section of the first protrusion part 52*a* on the inserting direction side.

However, in the retaining protrusion 52 illustrated here, a groove part 52*c* is formed on the wall surface on the removing direction side along the assembling direction of the terminal retaining member 50 with respect to the projection part 22 of the housing 20 (FIG. 3, FIG. 5, FIG. 12, and FIG. 13).

In the housing 20 illustrated here, the three first penetration holes 22*b* in the projection part 22 have the same hole shape as the penetration holes 13 in order to enable the insertion of the retaining protrusion 52 (FIG. 10). The first penetration hole 22*b* may be formed to have the same shape and the same size as the hole shape of the penetration hole 13, or the shape similar to the hole shape of the penetration hole 13.

While the engagement part 21 is inserted into and engaged with the inside of the counterpart engagement part 521, a part of the housing 20 on the removing direction side relative to the engagement part 21 projects from the counterpart engagement part 521. This housing 20 includes an electric wire housing part 23 with a tubular shape for housing the electric wire We internally, and the electric wire housing part 23 corresponds to the projection part from the counterpart engagement part 521 on the removing direction side (FIG. 1, FIG. 8, FIG. 10, and FIG. 11). The electric wire housing part 23 illustrated here is formed in a cylindrical shape, and is provided for each electric wire We. The respective electric wire housing parts 23 are arranged in the direction where the three terminals fittings are arranged. This housing 20 includes a tubular part 24 between the engagement part 21 and each electric wire housing part 23. The tubular part 24 has the same axis as the tube axis of the engagement part 21 and is provided outside the outer peripheral wall surface 21*a* of the engagement part 21 (FIG. 1, FIG. 3 to FIG. 8, FIG. 10, and FIG. 11). The tubular part 24 illustrated here is formed so that the cross-section orthogonal to the tube axis has an elliptical tubular shape.

In this housing 20, the electric wire We with the terminal fitting 10 is inserted from an opening 23*a* of the electric wire housing part 23 (FIG. 8, FIG. 10, and FIG. 11). Therefore, the electric wire We is drawn outward from the opening 23*a*. Here, between the electric wire housing part 23 and the electric wire We, an annular space is formed. In view of this, in this connector 1, the electric wire We is inserted first through an annular water-stopping member (so-called rubber stopper) 43 (FIG. 8), and then, by inserting the water-stopping member 43 together with the electric wire We into the electric wire housing part 23, the annular space between the electric wire housing part 23 and the electric wire We is closed.

In this connector 1, between the opening 23*a* of the electric wire housing part 23 and the water-stopping member 43, a rear holder 25 for holding the electric wire We while suppressing the bending of the electric wire We is assembled (FIG. 8). The rear holder 25 in this example has a two-split structure of a first holder member 25A and a second holder member 25B, and the first holder member 25A and the second holder member 25B have the respective electric wires We held therebetween. The respective electric wires We are drawn outward from the openings 23*a* through the rear holder 25. Although not described in detail, the rear holder 25 is held by the respective electric wire housing parts 23 in a manner that a claw part provided to each of the first holder member 25A and the second holder member 25B is inserted into a penetration hole of each electric wire housing part 23. The first holder member 25A and the second holder member 25B are molded of an insulating material such as synthetic resin, for example.

The shield shell 30 suppresses the entry of noise from the outside to the internal electric wire We by covering the electric wire housing part 23 from the outside. Thus, this shield shell 30 is molded of a metal material (for example, aluminum or aluminum alloy).

This shield shell 30 includes a tubular part 31 that covers the electric wire housing part 23 from the outside and a flange part 32 that covers the electric wire housing part 23 side of the tubular part 24 from the outside (FIG. 1 and FIG. 8). The tubular part 31 is formed so that the cross-section thereof orthogonal to the tube axis has an elliptical tubular shape, and along the longitudinal direction of the ellipse, the three electric wire housing parts 23 are arranged in parallel. The flange part 32 has the same axis as the tube axis of the tubular part 31, and is formed to have a flat plate shape and an annular shape projecting outward over an outer peripheral surface of the tubular part 31. This flange part 32 is fixed to the casing 501 with a screw in a manner that a plane of the flange part 32 is in surface contact with a plane of the casing 501.

This connector 1 includes a braid (not illustrated) covering the outer peripheral surface of the tubular part 31 and the electric wire We drawn out of the opening 23*a*. The braid is a member formed of a metal material with a tubular shape and braided into a mesh shape. The braid suppresses the entry of noise to the electric wire We drawn out of the opening 23*a*. This braid is in pressure contact with the outer peripheral surface of the tubular part 31 using a tubular connection member 35 (FIG. 1 and FIG. 8).

The connector 1 includes a front holder 60 to which the housing 20 is inserted from its end (that is, projection part 22) and in which the terminal retaining member 50 is retained at the final retaining position (assembling complete position) (FIG. 1 to FIG. 4, FIG. 7, and FIG. 8). This front holder 60 is to retain at least a part of the main body 51 of the terminal retaining member 50 at the final retaining position so that the terminal retaining member 50 remains at the final retaining position. The front holder 60 illustrated here covers the entire main body 51 of the terminal retaining member 50 at the final retaining position from outside and retains the terminal retaining member 50 so that the terminal retaining member 50 remains at the final retaining position. Therefore, the front holder 60 illustrated here is molded so that the projection part 22 is inserted inward together with the terminal retaining member 50 at the final retaining position. Here, the front holder 60 is molded so that the engagement part 21 and the projection part 22 are inserted inward together with the terminal retaining member 50 at the final retaining position.

Inside this front holder 60, the engagement part 21, the projection part 22, and the terminal retaining member 50 at the final retaining position are inserted from an insertion port 60*a* (FIG. 8) along the inserting direction. The front holder 60, by retaining the terminal retaining member 50 at the final retaining position, prevents the terminal retaining member 50 from being detached from the projection part 22 and accordingly, keeps the terminal fitting 10 at the housing complete position, which is housed together with the engagement part 21 and the like, in the housing 20 while the terminal fitting 10 remains at the housing complete position.

This front holder 60 includes a tubular part 61 to which the engagement part 21 is inserted (hereinafter referred to as "first tubular part"), and a tubular part 62 to which the projection part 22 is inserted together with the terminal retaining member 50 (hereinafter referred to as "second tubular part") (FIG. 1 to FIG. 4, FIG. 7, and FIG. 8). The front holder 60 moreover includes opposing wall parts 63*a* and 63*b* that are provided at one end of the first tubular part 61 on the inserting direction side and are disposed to face each other on the inserting direction side with respect to the end surfaces 21*b* and 21*c* of the engagement part 21 (FIG. 3, FIG. 4, and FIG. 7). Here, the end surface 21*b* and the opposing wall part 63*a* are disposed to face each other and the end surface 21*c* and the opposing wall part 63*b* are disposed to face each other.

The first tubular part 61 has the same axis as the tube axis of the engagement part 21, and is formed so that the cross-section orthogonal to the tube axis has an elliptical tubular shape. By a holding mechanism 65 provided between the first tubular part 61 and the engagement part 21, the engagement part 21 holds the front holder 60 (FIG. 7). In the holding mechanism 65 illustrated here, a retaining part 65*a* provided to the outer peripheral wall surface 21*a* of the engagement part 21 and a retained part 65*b* provided to the first tubular part 61 are disposed so as to be retained together in the range of the allowable relative movement quantity in design in the inserting and removing direction. Thus, this holding mechanism 65 retains the relative movement between the engagement part 21 and the first tubular part 61 in the inserting and removing direction in the range of the allowable relative movement quantity, and causes the engagement part 21 to hold the front holder 60. The retaining part 65*a* is formed on the outer peripheral wall surface 21*a* of the engagement part 21 as a groove or a penetration hole. The retained part 65*b* is formed as a claw part that is inserted into the retaining part 65*a*, which is the groove or the penetration hole, and that is retained by an inner peripheral wall surface of the groove or the penetration hole. The first tubular part 61 illustrated here includes a piece part 65*c* with flexibility and a cantilever shape extending in the tube axis direction, and makes the retained part 65*b* project from a free end of the piece part 65*c*. Between the engagement part 21 and the first tubular part 61, such holding mechanisms 65 are provided at four positions. Here, two holding mechanisms 65 are provided at each end part on the outer peripheral wall surface 21*a* side in the direction orthogonal to the inserting direction and to the direction where the three terminal fittings 10 are arranged.

The second tubular part 62 projects to the inserting direction side over the opposing wall parts 63*a* and 63*b* between the opposing wall parts 63*a* and 63*b* at one end of the first tubular part 61 in the tube axis direction. The second tubular part 62 covers the main body 51 of the terminal retaining member 50 at the final retaining position with an inner peripheral surface of the second tubular part 62 and retains the terminal retaining member 50 so that the terminal retaining member 50 at the final retaining position (assembling complete position) and the projection part 22 are housed inside and the terminal retaining member 50 remains at the final retaining position. In addition, this second tubular part 62 makes the end part of the terminal connection part 11 on the penetration hole 11*a* side project from the inside.

In the front holder 60 illustrated here, an opening at the other end of the first tubular part 61 in the tube axis direction is used as the insertion port 60*a*. In the front holder 60 illustrated here, a part of the engagement part 21 on the removing direction side projects from the insertion port 60*a*. Therefore, in this front holder 60, an annular end surface of the first tubular part 61 on the insertion port 60*a* side is disposed to face an annular end surface of the tubular part 24 of the housing 20 with a space therebetween in the inserting and removing direction. In this connector 1, between the annular end surface of the first tubular part 61 on the insertion port 60*a* side and the annular end surface of the tubular part 24 of the housing 20, an annular groove whose groove bottom is the outer peripheral wall surface 21*a* of the engagement part 21 is formed. In this connector 1, an annular water-stopping member 44 is provided to the annular groove (FIG. 1 to FIG. 8, and FIG. 11).

The water-stopping member 44 is molded of a synthetic resin material that is elastically deformable, such as rubber. This water-stopping member 44 includes a tubular base part 44*a*, annular lips 44*b* with the same axis projecting from an inner peripheral surface of this base part 44*a* (hereinafter referred to as "inner peripheral lips"), and annular lips 44*c* with the same axis projecting from an outer peripheral surface of this base part 44*a* (hereinafter referred to as "outer peripheral lips") (FIG. 11). In this water-stopping member 44, the inner peripheral lips 44*b* and the outer peripheral lips 44*c* are arranged in the tube axis direction of the base part 44*a*. The water-stopping member 44 illustrated here includes two inner peripheral lips 44*b* and two outer peripheral lips 44*c*. The base part 44*a* illustrated here is formed so that the cross-section thereof orthogonal to the tube axis has an elliptical tubular shape. Then, the inner peripheral lips 44*b* and the outer peripheral lips 44*c* illustrated here are formed so that the cross-sections thereof orthogonal to the tube axis of the base part 44*a* each have an elliptical annular shape.

This water-stopping member 44 has the inner peripheral side engaged with a projection part 21$a_1$ from the insertion port 60*a* of the front holder 60 on the outer peripheral wall surface 21*a* of the engagement part 21 (FIG. 7). This water-stopping member 44, when assembled to the projection part 21$a_1$, has the inner peripheral lips 44*b* on the inner peripheral side elastically deformed so that the inner peripheral lips 44*b* are in close contact with the projection part 21$a_1$. When the engagement part 21 and the counterpart engagement part 521 are in the inserted and engaged state, the water-stopping member 44 elastically deforms the outer peripheral lips 44*c* on the outer peripheral side so that the outer peripheral lips 44*c* are in close contact with the inner peripheral wall surface 521*a* of the counterpart engagement part 521. The water-stopping member 44 closes the annular space between the projection part 21$a_1$ of the outer peripheral wall surface 21*a* and the inner peripheral wall surface 521*a* of the counterpart engagement part 521 in this manner, so that the entry of liquid such as water into the casing 501 from between the engagement part 21 and the counterpart engagement part 521 is prevented.

In the water-stopping member 44 illustrated here, the base part 44*a* projects over the inner peripheral lips 44*b* and the outer peripheral lips 44*c* on one side in the tube axis direction (FIG. 7). Here, a projection part 44$a_1$ of the base part 44*a* is disposed on the first tubular part 61 side of the front holder 60. The first tubular part 61 covers an outer peripheral surface of an end part of the projection part 44$a_1$ on the inserting direction side. That is to say, the end part of the first tubular part 61 on the insertion port 60*a* side has a flipping suppressing function for suppressing the flipping of the base part 44*a*, for example.

This water-stopping member 44 is positioned by the housing 20 and the front holder 60 on the tube axis with respect to the engagement part 21. A positioning mechanism 45 in the tube axis direction (hereinafter referred to as "first positioning mechanism") includes a first retaining part 45*a* using the tubular part 24, a second retaining part 45*b* provided to the first tubular part 61 of the front holder 60, a first retained part 45*c* using the other end surface of the base part 44*a* in the tube axis direction, and a second retained part 45*d* using one end surface of the base part 44*a* in the tube axis direction (end surface of projection part 44$a_1$) (FIG. 3). In this first positioning mechanism 45, the first retaining part 45*a* and the first retained part 45*c* are disposed to face each other in the tube axis direction, and the second retaining part 45*b* and the second retained part 45*d* are disposed to face each other in the tube axis direction. The first positioning mechanism 45 is set so that the total value of the distance between a pair of the first retaining part 45*a* and the first retained part 45*c* in the tube axis direction and the distance between a pair of the second retaining part 45*b* and the second retained part 45*d* in the tube axis direction is within the range of the allowable relative movement quantity in design in the tube axis direction of the water-stopping member 44 with respect to the engagement part 21. The allowable relative movement quantity is determined in consideration of tolerance variation or the like of the housing 20, the front holder 60, and the water-stopping member 44. Thus, the first positioning mechanism 45 keeps the position of the water-stopping member 44 on the tube axis with respect to the engagement part 21 the position in the defined range in the design. That is to say, the tubular part 24 of the housing 20 illustrated here has a retaining function of retaining the water-stopping member 44 at an engagement complete position with respect to the engagement part 21. The front holder 60 illustrated here has a retaining function of retaining the water-stopping member 44 at the engagement complete position with respect to the engagement part 21.

This water-stopping member 44 includes a positioning mechanism 46 (hereinafter referred to as "second positioning mechanism") for positioning the engagement part 21 in a circumferential direction between the water-stopping member 44 and the engagement part 21 (FIG. 2, FIG. 7, FIG. 10, and FIG. 11). In this second positioning mechanism 46, a retaining part 46*a* provided to the engagement part 21 and a retained part 46*b* provided to the water-stopping member 44 are disposed so as to be retained together in the range of the allowable relative movement quantity in design in the circumferential direction. The allowable relative movement quantity is determined in consideration of the tolerance variation or the like of the housing 20 and the water-stopping member 44. Thus, the second positioning mechanism 46 retains the relative movement between the engagement part 21 and the water-stopping member 44 in the circumferential direction in the range of the allowable relative movement quantity, and keeps the position of the water-stopping member 44 in the circumferential direction with respect to the engagement part 21 the position in the defined range in the design.

The retaining part 46*a* is provided to the outer peripheral wall surface 21*a* of the engagement part 21 as a groove or a penetration hole. This retaining part 46*a* allows the retained part 46*b* to be inserted and retained. The retaining part 46*a* illustrated here retains the inserted retained part 46*b* with one inner peripheral wall surface and the other inner peripheral wall surface in the circumferential direction. However, this retaining part 46*a* may retain the inserted retained part 46*b* in the tube axis direction of the water-stopping member 44. The retaining parts 46*a* illustrated here are arranged in the tube axis direction with respect to the retaining parts 65*a* of the holding mechanisms 65 and communicate with the retaining parts 65*a*.

The retained part 46*b* is formed as a protrusion part that can be inserted into the retaining part 46*a* as the groove or the penetration hole. This retained part 46*b* projects inward relative to the inner peripheral surface of the water-stopping member 44. The retained part 46*b* illustrated here projects over a top of the inner peripheral lip 44*b*. The retained part 46*b* illustrated here is formed to have a rectangular piece body shape having a plane orthogonal to the tube axis direction.

Between the water-stopping member 44 and the engagement part 21 illustrated here, such second positioning mechanisms 46 are provided at four positions with a space therebetween in the circumferential direction. Here, the two second positioning mechanisms 46 are provided at each end part on the outer peripheral wall surface 21*a* side in the direction orthogonal to the inserting direction and the direction where the three terminal fittings 10 are arranged.

As described above, in the connector 1 according to the present embodiment, the assembling of the terminal retaining member 50 to the projection part 22 of the housing 20 can be completed only when the terminal fitting 10 is disposed correctly at the housing complete position. Therefore, in this connector 1, whether the terminal fitting 10 is disposed correctly can be detected in the manufacturing stage; thus, the commercial quality as a product (durability of product, conducting performance with the counterpart terminal fitting, etc.) can be secured.

Incidentally, in the aforementioned examples, the penetration holes 13 with the same shape are provided to all the terminal fittings 10 and in accordance with these, all the retaining protrusions 52 of the terminal retaining member 50 are formed as the protrusion bodies with the same shape. However, this connector 1 may be configured as below in order to avoid the wrong placement of the terminal fittings 10.

Figure 16:
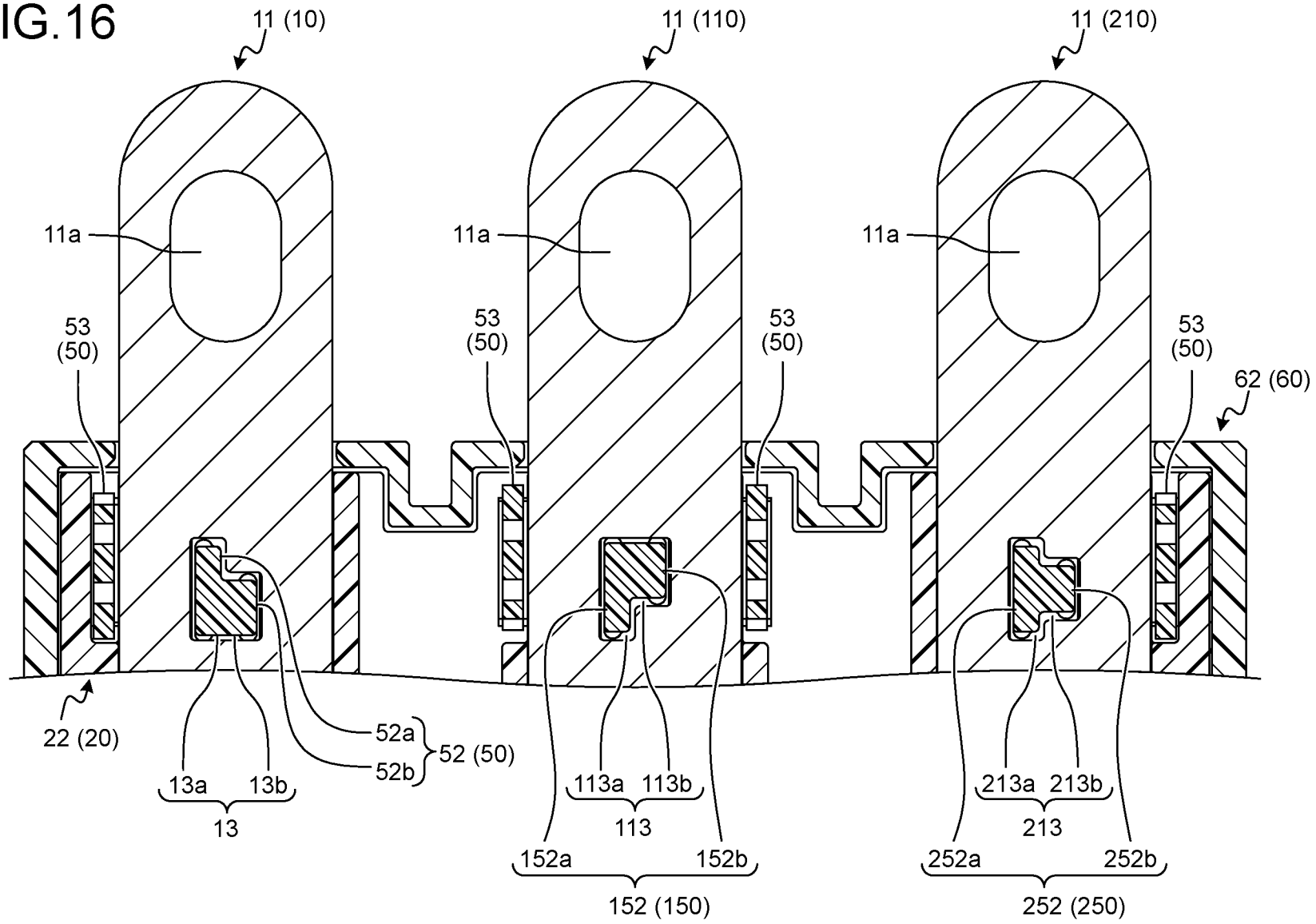
FIG. 16 is a diagram for describing a modification of the retaining protrusions and the penetration holes.

In this connector 1, one of the three terminal fittings 10 (hereinafter referred to as "first terminal fitting 10") is left and the other two are replaced by a second terminal fitting 110 and a third terminal fitting 210 (FIG. 16). The second terminal fitting 110 corresponds to the first terminal fitting 10 in which the penetration hole 13 is replaced by a penetration hole 113. The third terminal fitting 210 corresponds to the first terminal fitting 10 in which the penetration hole 13 is replaced by a penetration hole 213.

Moreover, this connector 1 includes a terminal retaining member 150 instead of the terminal retaining member 50 (FIG. 16). The terminal retaining member 150 corresponds to the terminal retaining member 50 in which one of the three retaining protrusions 52 (hereinafter referred to as "first retaining protrusion 52") is left and the other two are replaced by a second retaining protrusion 152 and a third retaining protrusion 252. Note that the first retaining protrusion 52 illustrated here does not include the groove part 52*c*.

Figure 17:
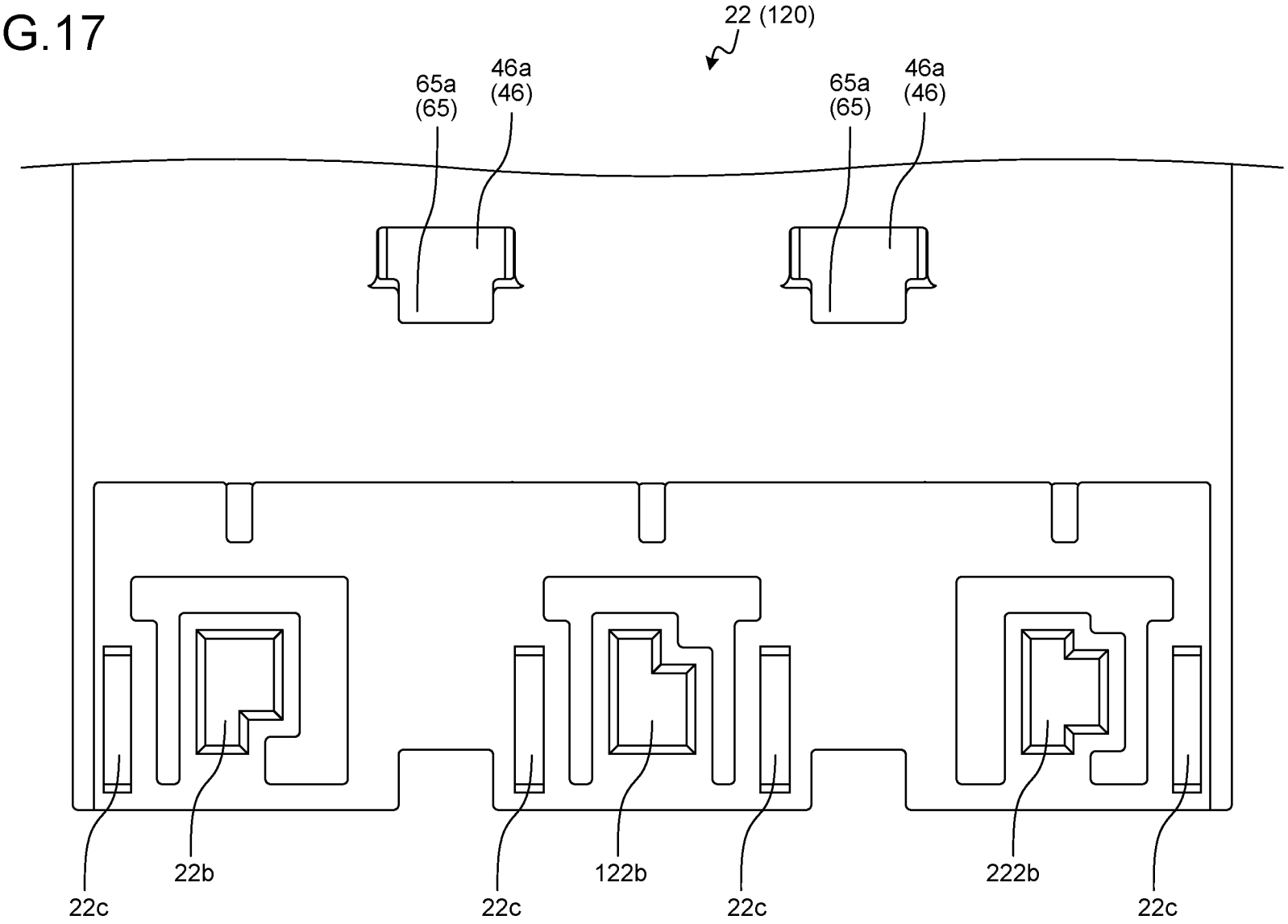
FIG. 17 is a diagram for describing a housing applicable to the retaining protrusions according to the modification.

This connector 1 includes a housing 120 instead of the housing 20 (FIG. 17). The housing 120 corresponds to the housing 20 in which one of the three first penetration holes 22*b* (hereinafter referred to as "first insertion hole 22*b*") is left and the other two are replaced by a second insertion hole 122*b* and a third insertion hole 222*b*.

First, the terminal fittings (first terminal fitting 10, second terminal fitting 110, third terminal fitting 210) are molded as the terminal fittings respectively having the penetration holes 13, 113, and 213 with the left-right asymmetric shapes that are different from each other. The terminal retaining member 150 includes the retaining protrusions (first retaining protrusion 52, second retaining protrusion 152, third retaining protrusion 252) that are formed to have the shapes that can be inserted only in the penetration holes 13, 113, and 213 for the respective penetration holes 13, 113, and 213 of the terminal fittings (first terminal fitting 10, second terminal fitting 110, third terminal fitting 210).

The penetration hole 113 of the second terminal fitting 110, like the penetration hole 13, is formed as the penetration hole with the rectangular hole shape in which the first hole part 113*a* on the left side in the terminal left-right direction and the second hole part 113*b* on the right side in the terminal left-right direction include the side parts extending along the inserting and removing direction and the terminal left-right direction and the rectangular area of the second hole part 113*b* is smaller than the rectangular area of the first hole part 113*a* (FIG. 16). However, in this penetration hole 113, the side parts of the first hole part 113*a* and the second hole part 113*b* on the inserting direction side are arranged at the same position in the inserting and removing direction, and the side part of the second hole part 113*b* on the removing direction side is arranged displaced to the inserting direction side relative to the side part of the first hole part 113*a* on the removing direction side.

The second retaining protrusion 152 to be fitted into the penetration hole 113 is, like the first retaining protrusion 52, for example, formed as the protrusion body whose cross-sectional shape orthogonal to the assembling direction of the terminal retaining member 150 with respect to the projection part 22 of the housing 120 (inserting direction to the penetration hole 113) is similar to the hole shape of the penetration hole 113. The homothetic ratio between the orthogonal cross-sectional shape of the second retaining protrusion 152 and the hole shape of the penetration hole 113 is less than 1, and with these shapes, the second retaining protrusion 152 can be fitted into the penetration hole 113.

The second retaining protrusion 152 illustrated here is formed as the protrusion body with the rectangular cross-sectional shape in which the first protrusion part 152*a* on the left side and the second protrusion part 152*b* on the right side in the orthogonal cross-sectional shape include the side parts extending along the inserting and removing direction and the terminal left-right direction and the rectangular cross-section of the first protrusion part 152*a* can be fitted to the first hole part 113*a* and the rectangular cross-section of the second protrusion part 152*b* can be fitted to the second hole part 113*b* (FIG. 16). Therefore, the second retaining protrusion 152 illustrated here is, like the first retaining protrusion 52, formed as the protrusion body in which the area of the rectangular cross-section of the second protrusion part 152*b* is smaller than the area of the rectangular cross-section of the first protrusion part 152*a* in the orthogonal cross-sectional shape. However, in the second retaining protrusion 152 illustrated here, in the orthogonal cross-sectional shape thereof, the side parts of the rectangular cross-section of the first protrusion part 152*a* and the rectangular cross-section of the second protrusion part 152*b* on the inserting direction side are arranged at the same position in the inserting and removing direction, and the side part of the rectangular cross-section of the second protrusion part 152*b* on the removing direction side is arranged displaced to the inserting direction side relative to the side part of the rectangular cross-section of the first protrusion part 152*a* on the removing direction side.

The second insertion hole 122*b* of the housing 120 through which the second retaining protrusion 152 passes is formed to have the same hole shape as the penetration hole 113 (FIG. 17). The second insertion hole 122*b* may be formed to have the same shape and the same size as the hole shape of the penetration hole 113, or the shape similar to the hole shape of the penetration hole 113.

The penetration hole 213 of the third terminal fitting 210 is, like the penetration hole 13, formed as the penetration hole with the rectangular hole shape in which the first hole part 213*a* on the left side in the terminal left-right direction and the second hole part 213*b* on the right side in the terminal left-right direction include the side parts extending along the inserting and removing direction and the terminal left-right direction and the rectangular area of the second hole part 213*b* is smaller than the rectangular area of the first hole part 213*a* (FIG. 16). However, in this penetration hole 213, the side part of the second hole part 213*b* on the inserting direction side is arranged displaced to the removing direction side relative to the side part of the first hole part 213*a* on the inserting direction side and the side part of the second hole part 213*b* on the removing direction side is arranged displaced to the inserting direction side relative to the side part of the first hole part 213*a* on the removing direction side. That is to say, this penetration hole 213 is formed to have a convex hole shape.

The third retaining protrusion 252 to be fitted into the penetration hole 213 is, like the first retaining protrusion 52, for example, formed as the protrusion body whose cross-sectional shape orthogonal to the assembling direction of the terminal retaining member 150 with respect to the projection part 22 of the housing 120 (inserting direction to the penetration hole 213) is similar to the hole shape of the penetration hole 213. That is to say, the third retaining protrusion 252 is formed as the protrusion whose orthogonal cross-sectional shape is convex. The homothetic ratio between the orthogonal cross-sectional shape of the third retaining protrusion 252 and the hole shape of the penetration hole 213 is less than 1, and with these shapes, the third retaining protrusion 252 can be fitted into the penetration hole 213.

The third retaining protrusion 252 illustrated here is formed as the protrusion body with the rectangular cross-sectional shape in which the first protrusion part 252*a* on the left side and the second protrusion part 252*b* on the right side in the orthogonal cross-sectional shape include the side parts extending along the inserting and removing direction and the terminal left-right direction and the rectangular cross-section of the first protrusion part 252*a* can be fitted to the first hole part 213*a* and the rectangular cross-section of the second protrusion part 252*b* can be fitted to the second hole part 213*b* (FIG. 16). Therefore, the third retaining protrusion 252 illustrated here is, like the first retaining protrusion 52, formed as the protrusion body in which the area of the rectangular cross-section of the second protrusion part 252*b* is smaller than the area of the rectangular cross-section of the first protrusion part 252*a* in the orthogonal cross-sectional shape. However, in the third retaining protrusion 252 illustrated here, in the orthogonal cross-sectional shape thereof, the side part of the rectangular cross-section of the second protrusion part 252*b* on the inserting direction side is arranged displaced to the removing direction side relative to the side part of the rectangular cross-section of the first protrusion part 252*a* on the inserting direction side, and the side part of the rectangular cross-section of the second protrusion part 252*b* on the removing direction side is arranged displaced to the inserting direction side relative to the side part of the rectangular cross-section of the first protrusion part 252*a* on the removing direction side.

The third insertion hole 222*b* of the housing 120 through which the third retaining protrusion 252 passes is formed to have the same hole shape as the penetration hole 213 (FIG. 17). The third insertion hole 222*b* may be formed to have the same shape and the same size as the hole shape of the penetration hole 213, or the shape similar to the hole shape of the penetration hole 213.

In this connector 1, the assembling of the terminal retaining member 150 to the projection part 22 of the housing 120 can be completed only when all the terminal fittings (first terminal fitting 10, second terminal fitting 110, third terminal fitting 210) are disposed correctly at the respective housing complete positions. Therefore, in this connector 1, whether all the terminal fittings that are different (first terminal fitting 10, second terminal fitting 110, third terminal fitting 210) are disposed correctly can be detected in the manufacturing stage; thus, the commercial quality as a product (durability of product, conducting performance with the counterpart terminal fitting, etc.) can be secured.

In the connector according to the present embodiment, in the case where the terminal fitting is disposed correctly at the housing complete position in the housing, the retaining protrusion of the terminal retaining member can be fitted into the penetration hole of the terminal fitting; therefore, this terminal retaining member can be assembled at the assembling complete position in the housing. Accordingly, in such a case, this connector can notify the user, for example, that the terminal fitting is disposed correctly at the housing complete position in the housing. On the other hand, in the case of the connector where the terminal fitting is not disposed correctly at the housing complete position, the retaining protrusion of the terminal retaining member cannot be fitted into the penetration hole of the terminal fitting; therefore, this terminal retaining member cannot be assembled at the assembling complete position in the housing. Accordingly, in such a case, this connector can notify the user, for example, that the terminal fitting is not disposed correctly at the housing complete position in the housing. In this manner, the connector according to the present invention makes it possible to complete the assembling of the terminal retaining member to the housing only when the terminal fitting is disposed correctly at the housing complete position. Thus, in this connector, whether the terminal fitting is disposed correctly can be detected in the manufacturing stage.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

a terminal fitting attached to a terminal of an electric wire;

a housing that houses the terminal fitting at a housing complete position in a terminal housing room on an inner side and that is inserted into and engaged with a counterpart engagement part from an end along an inserting direction; and a terminal retaining member that is assembled to the housing from outside along an assembling direction orthogonal to the inserting direction and, at an assembling complete position to the housing, retains the terminal fitting remaining at the housing complete position, wherein the terminal fitting includes a penetration hole, the terminal retaining member includes a retaining protrusion that is, at the assembling complete position, inserted into the penetration hole at the housing complete position, and retains the terminal fitting at the housing complete position while the terminal fitting remains at that position, the penetration hole is formed to have a left-right asymmetric shape including a first hole part that is arranged on a left side in a terminal left-right direction orthogonal to the inserting direction and the assembling direction, and a second hole part that has a shape different from a shape of the first hole part and is arranged on a right side of the first hole part in the terminal left-right direction, and the retaining protrusion is formed to have a left-right asymmetric shape including a first protrusion part that is arranged on the left side in the terminal left-right direction and is, at the assembling complete position, fitted into the first hole part at the housing complete position, and a second protrusion part that has a shape different from a shape of the first protrusion part, is arranged on the right side of the first protrusion part in the terminal left-right direction, and is, at the assembling complete position, fitted into the second hole part at the housing complete position.

2. The connector according to claim 1, wherein at least the first protrusion part out of the first protrusion part and the second protrusion part is formed to have a shape that is able to be inserted into the first hole part and is not able to be inserted into the second hole part.

3. The connector according to claim 1, wherein the terminal fitting is one of a plurality of terminal fittings, the housing includes the terminal housing room for each of the plurality of terminal fittings, the terminal fittings include the respective penetration holes with different shapes that are left-right asymmetric, and the terminal retaining member includes the retaining protrusion for each of the penetration holes of the terminal fittings, the retaining protrusion being formed to have a shape that is able to be inserted only into the corresponding penetration hole.

4. The connector according to claim 2, wherein the terminal fitting is one of a plurality of terminal fittings, the housing includes the terminal housing room for each of the plurality of terminal fittings, the terminal fittings include the respective penetration holes with different shapes that are left-right asymmetric, and the terminal retaining member includes the retaining protrusion for each of the penetration holes of the terminal fittings, the retaining protrusion being formed to have a shape that is able to be inserted only into the corresponding penetration hole.

* * * * *